US010775030B2

(12) United States Patent
Antony et al.

(10) Patent No.: US 10,775,030 B2
(45) Date of Patent: Sep. 15, 2020

(54) LIGHT FIXTURE DEVICE INCLUDING ROTATABLE LIGHT MODULES

(71) Applicant: Flex Ltd., Singapore (SG)

(72) Inventors: Ashish Antony, Anna, TX (US); Jordon Musser, Dallas, TX (US)

(73) Assignee: FLEX LTD., Singapore (SG)

( * ) Notice: Subject to any disclaimer, the term of this patent is extended or adjusted under 35 U.S.C. 154(b) by 46 days.

(21) Appl. No.: 15/799,040

(22) Filed: Oct. 31, 2017

(65) Prior Publication Data

US 2018/0320870 A1 Nov. 8, 2018

Related U.S. Application Data

(60) Provisional application No. 62/502,026, filed on May 5, 2017.

(51) Int. Cl.
*F21V 21/30* (2006.01)
*F21V 19/00* (2006.01)
(Continued)

(52) U.S. Cl.
CPC ..... *F21V 21/30* (2013.01); *F21S 4/28* (2016.01); *F21S 8/026* (2013.01); *F21S 8/03* (2013.01);
(Continued)

(58) Field of Classification Search
CPC ..... F21V 21/30; F21V 5/045; F21V 19/02; F21S 8/026; F21S 8/03; F21S 8/04; F21S 8/046
See application file for complete search history.

(56) References Cited

U.S. PATENT DOCUMENTS

D120,548 S 5/1940 Guth
D122,145 S 8/1940 MacCarthy
(Continued)

FOREIGN PATENT DOCUMENTS

CN 205746327 U 11/2016
DE 102007056280 B3 7/2009
(Continued)

OTHER PUBLICATIONS

Extended European Search Report issued in corresponding Appl. No. EP 18169515.6 dated Aug. 31, 2018 (13 pages).
(Continued)

*Primary Examiner* — Karabi Guharay
(74) *Attorney, Agent, or Firm* — Weber Rosselli & Cannon LLP

(57) ABSTRACT

A device for directing light is provided. The device includes at least two light modules adapted to provide a fixture for a light source. The at least two light modules are linear, parallel to a central axis, substantially in a plane with the central axis, and arranged on both sides of the central axis in the plane. A first inner endcap is provided that is arranged on a first end of the at least two light modules and a second inner endcap is provided that is arranged on a second end of the at least two light modules. The first end opposes the second end along a length of the at least two light modules. The first and second inner endcaps provide a fixed, rotational axis for one of the light modules, and provide two locking positions to determine a rotational position for the light module.

21 Claims, 12 Drawing Sheets

(51) Int. Cl.

| | |
|---|---|
| ***F21V 5/04*** | (2006.01) |
| ***F21V 15/01*** | (2006.01) |
| ***F21S 8/02*** | (2006.01) |
| ***F21V 19/02*** | (2006.01) |
| ***F21S 8/04*** | (2006.01) |
| ***F21S 8/00*** | (2006.01) |
| ***F21V 14/02*** | (2006.01) |
| ***F21S 4/28*** | (2016.01) |
| *F21Y 115/10* | (2016.01) |
| *F21Y 103/10* | (2016.01) |

(52) U.S. Cl.

CPC ..... *F21S 8/04* (2013.01); *F21S 8/046* (2013.01); *F21V 5/045* (2013.01); *F21V 14/02* (2013.01); *F21V 15/013* (2013.01); *F21V 19/0055* (2013.01); *F21V 19/02* (2013.01); *F21Y 2103/10* (2016.08); *F21Y 2115/10* (2016.08)

(56) References Cited

U.S. PATENT DOCUMENTS

| | | | |
|---|---|---|---|
| D122,887 | S | 10/1940 | Beals |
| D123,067 | S | 10/1940 | Rubinstein |
| D123,887 | S | 12/1940 | Koehler |
| D127,398 | S | 5/1941 | Jordan |
| D128,961 | S | 8/1941 | Hrabak |
| D129,726 | S | 9/1941 | Scribner |
| D130,570 | S | 12/1941 | Borkland |
| 2,312,617 | A | 3/1943 | Beck |
| D139,669 | S | 12/1944 | Lippincott |
| D142,126 | S | 8/1945 | Sabatini |
| D150,735 | S | 8/1948 | Schwartz et al. |
| D151,575 | S | 10/1948 | Winkler et al. |
| 2,606,998 | A | 8/1952 | Winkler et al. |
| D173,255 | S | 10/1954 | Brooks et al. |
| 2,715,449 | A | 8/1955 | Lemmerman et al. |
| D188,436 | S | 7/1960 | Budke et al. |
| 3,009,055 | A | 11/1961 | Franzese |
| 3,209,142 | A | 9/1965 | Michel et al. |
| D208,491 | S | 9/1967 | Brooks |
| D255,851 | S | 7/1980 | Crane |
| D291,598 | S | 8/1987 | Elkerbout |
| 4,726,781 | A | 2/1988 | Bernhart et al. |
| 6,061,978 | A | 5/2000 | Dinwoodie et al. |
| 6,076,943 | A | 6/2000 | Lassovsky |
| 6,274,402 | B1 | 8/2001 | Verlinden et al. |
| 6,295,818 | B1 | 10/2001 | Ansley et al. |
| 6,313,395 | B1 | 11/2001 | Crane et al. |
| 6,333,457 | B1 | 12/2001 | Mulligan et al. |
| 6,337,283 | B1 | 1/2002 | Verlinden et al. |
| 6,387,726 | B1 | 5/2002 | Verlinden et al. |
| 6,423,568 | B1 | 7/2002 | Verlinden et al. |
| 6,495,750 | B1 | 12/2002 | Dinwoodie |
| 6,501,013 | B1 | 12/2002 | Dinwoodie |
| D472,007 | S | 3/2003 | Weitgasser |
| 6,536,326 | B2 | 3/2003 | Unger et al. |
| 6,570,084 | B2 | 5/2003 | Dinwoodie |
| 6,684,637 | B2 | 2/2004 | Beale |
| 6,722,357 | B2 | 4/2004 | Shingleton |
| 6,745,687 | B1 | 6/2004 | Kaminar |
| D492,809 | S | 7/2004 | Weitgasser |
| 6,809,251 | B2 | 10/2004 | Dinwoodie |
| 6,809,253 | B2 | 10/2004 | Dinwoodie |
| 6,883,290 | B2 | 4/2005 | Dinwoodie |
| D510,315 | S | 10/2005 | Shugar et al. |
| D511,576 | S | 11/2005 | Shingleton et al. |
| D516,017 | S | 2/2006 | Mascolo |
| 6,998,288 | B1 | 2/2006 | Smith et al. |
| D519,444 | S | 4/2006 | Mascolo |
| D521,172 | S | 5/2006 | Chen |
| 7,072,096 | B2 | 7/2006 | Holman et al. |
| 7,135,350 | B1 | 11/2006 | Smith et al. |
| 7,140,742 | B2 | 11/2006 | Pohlert et al. |
| 7,144,214 | B2 | 12/2006 | Kinpara et al. |
| 7,155,870 | B2 | 1/2007 | Almy |
| 7,172,184 | B2 | 2/2007 | Pavani et al. |
| 7,178,295 | B2 | 2/2007 | Dinwoodie |
| 7,178,941 | B2 | 2/2007 | Roberge et al. |
| 7,261,436 | B2 | 8/2007 | Haugaard et al. |
| 7,287,883 | B1 * | 10/2007 | Plunk ..... F21V 21/112 362/148 |
| 7,297,865 | B2 | 11/2007 | Terao et al. |
| 7,297,866 | B2 | 11/2007 | Aschenbrenner |
| D562,225 | S | 2/2008 | Almy et al. |
| 7,328,534 | B2 | 2/2008 | Dinwoodie |
| RE40,158 | E | 3/2008 | Weitgasser |
| D564,958 | S | 3/2008 | Almy et al. |
| 7,339,110 | B1 | 3/2008 | Mulligan et al. |
| D565,505 | S | 4/2008 | Shugar et al. |
| 7,388,147 | B2 | 6/2008 | Mulligan et al. |
| 7,390,961 | B2 | 6/2008 | Aschenbrenner et al. |
| 7,435,134 | B2 | 10/2008 | Lenox |
| 7,438,432 | B2 | 10/2008 | Yaphe et al. |
| 7,455,787 | B2 | 11/2008 | Rose et al. |
| 7,468,485 | B1 | 12/2008 | Swanson |
| D586,737 | S | 2/2009 | Shugar et al. |
| D592,785 | S | 5/2009 | Bisberg et al. |
| 7,530,830 | B1 | 5/2009 | Lenox |
| 7,554,030 | B2 | 6/2009 | Shingleton |
| 7,554,031 | B2 | 6/2009 | Swanson et al. |
| 7,557,292 | B2 | 7/2009 | Shingleton et al. |
| 7,622,912 | B1 | 11/2009 | Adams et al. |
| 7,633,006 | B1 | 12/2009 | Swanson |
| 7,648,257 | B2 | 1/2010 | Villard |
| 7,663,342 | B2 | 2/2010 | Kimball et al. |
| 7,670,638 | B2 | 3/2010 | Luan et al. |
| 7,681,090 | B2 | 3/2010 | Kimball et al. |
| 7,705,237 | B2 | 4/2010 | Swanson |
| 7,708,578 | B1 | 5/2010 | Lenox |
| 7,718,888 | B2 | 5/2010 | Cousins |
| 7,737,357 | B2 | 6/2010 | Cousins |
| 7,755,916 | B2 | 7/2010 | Krein et al. |
| 7,774,998 | B2 | 8/2010 | Aschenbrenner |
| 7,780,472 | B2 | 8/2010 | Lenox |
| 7,786,375 | B2 | 8/2010 | Swanson et al. |
| 7,804,022 | B2 | 9/2010 | De Ceuster |
| 7,807,918 | B2 | 10/2010 | Shingleton et al. |
| 7,812,250 | B2 | 10/2010 | Smith |
| 7,820,475 | B2 | 10/2010 | De Ceuster et al. |
| 7,824,070 | B2 | 11/2010 | Higley et al. |
| 7,838,062 | B2 | 11/2010 | Cousins et al. |
| 7,851,698 | B2 | 12/2010 | De Ceuster et al. |
| D632,418 | S | 2/2011 | Bisberg et al. |
| 7,883,343 | B1 | 2/2011 | Mulligan et al. |
| 7,888,587 | B2 | 2/2011 | Shingleton et al. |
| 7,888,588 | B2 | 2/2011 | Shingleton |
| 7,893,409 | B1 | 2/2011 | Cousins |
| 7,897,867 | B1 | 3/2011 | Mulligan et al. |
| 7,945,413 | B2 | 5/2011 | Krein |
| 7,956,281 | B2 | 6/2011 | O'Brien et al. |
| 7,958,886 | B2 | 6/2011 | Barsun et al. |
| 7,982,434 | B2 | 7/2011 | Kimball et al. |
| 7,994,657 | B2 | 8/2011 | Kimball et al. |
| 8,004,865 | B2 | 8/2011 | Krein et al. |
| 8,008,575 | B2 | 8/2011 | De Ceuster et al. |
| D644,609 | S | 9/2011 | Marroquin |
| D644,610 | S | 9/2011 | Marroquin |
| 8,029,683 | B2 | 10/2011 | Rose et al. |
| 8,061,091 | B2 | 11/2011 | Botkin et al. |
| 8,062,693 | B2 | 11/2011 | Cousins |
| 8,065,844 | B2 | 11/2011 | Botkin et al. |
| 8,080,819 | B2 | 12/2011 | Mueller et al. |
| 8,092,040 | B2 * | 1/2012 | Wu ..... F21V 7/0016 362/217.03 |
| 8,101,849 | B2 | 1/2012 | Almy et al. |
| 8,108,081 | B2 | 1/2012 | Lenox |
| 8,120,933 | B2 | 2/2012 | Chapman et al. |
| 8,134,217 | B2 | 3/2012 | Rim et al. |
| 8,148,627 | B2 | 4/2012 | Rose et al. |
| 8,158,877 | B2 | 4/2012 | Klein et al. |
| 8,163,638 | B2 | 4/2012 | De Ceuster et al. |
| 8,172,989 | B2 | 5/2012 | Pass |

(56) References Cited

U.S. PATENT DOCUMENTS

| | | | |
|---|---|---|---|
| 8,174,856 | B2 | 5/2012 | Chapman |
| 8,188,363 | B2 | 5/2012 | Xavier et al. |
| 8,192,048 | B2 | 6/2012 | Kristoffersen et al. |
| 8,192,056 | B2 | 6/2012 | Villard |
| 8,193,788 | B2 | 6/2012 | Chapman |
| 8,198,528 | B2 | 6/2012 | Luan et al. |
| 8,206,009 | B2 | 6/2012 | Tickner et al. |
| 8,207,444 | B2 | 6/2012 | Cousins |
| 8,207,637 | B2 | 6/2012 | Marroquin et al. |
| 8,211,731 | B2 | 7/2012 | Harley et al. |
| 8,215,071 | B2 | 7/2012 | Lenox |
| 8,220,210 | B2 | 7/2012 | Botkin et al. |
| 8,221,600 | B2 | 7/2012 | Ganti |
| 8,221,601 | B2 | 7/2012 | Chen et al. |
| 8,222,516 | B2 | 7/2012 | Cousins |
| 8,227,942 | B2 | 7/2012 | Marroquin et al. |
| 8,230,850 | B2 | 7/2012 | Barsun et al. |
| 8,234,824 | B2 | 8/2012 | Botkin et al. |
| 8,242,354 | B2 | 8/2012 | Smith |
| D666,974 | S | 9/2012 | Marroquin et al. |
| 8,258,395 | B2 | 9/2012 | Wares |
| 8,263,899 | B2 | 9/2012 | Harley et al. |
| 8,276,329 | B2 | 10/2012 | Lenox |
| 8,279,642 | B2 | 10/2012 | Chapman et al. |
| 8,279,649 | B2 | 10/2012 | Esram et al. |
| 8,284,574 | B2 | 10/2012 | Chapman et al. |
| 8,291,654 | B2 | 10/2012 | Botkin et al. |
| 8,294,022 | B2 | 10/2012 | Lenox |
| 8,304,644 | B2 | 11/2012 | Wares et al. |
| 8,308,324 | B2 | 11/2012 | Van Horn et al. |
| 8,317,987 | B2 | 11/2012 | Abas et al. |
| D673,320 | S | 12/2012 | Guercio et al. |
| 8,322,300 | B2 | 12/2012 | Pavani et al. |
| 8,324,015 | B2 | 12/2012 | Harley et al. |
| 8,325,499 | B2 | 12/2012 | Krein et al. |
| 8,334,161 | B2 | 12/2012 | Dennis et al. |
| 8,334,489 | B2 | 12/2012 | Beardsworth et al. |
| 8,336,539 | B2 | 12/2012 | Linderman et al. |
| 8,350,411 | B2 | 1/2013 | Kimball et al. |
| 8,350,417 | B1 | 1/2013 | Dooley et al. |
| 8,352,220 | B2 | 1/2013 | Wayne et al. |
| 8,360,601 | B2 | 1/2013 | Muschaweck et al. |
| 8,377,738 | B2 | 2/2013 | Dennis et al. |
| 8,378,706 | B2 | 2/2013 | Kinyon et al. |
| 8,393,707 | B2 | 3/2013 | Cudzinovic et al. |
| 8,399,287 | B1 | 3/2013 | Mulligan et al. |
| 8,402,703 | B2 | 3/2013 | Brandt et al. |
| 8,409,902 | B1 | 4/2013 | Harley et al. |
| 8,409,911 | B2 | 4/2013 | Cousins |
| 8,409,912 | B2 | 4/2013 | de Ceuster et al. |
| 8,423,312 | B2 | 4/2013 | Krein |
| 8,424,255 | B2 | 4/2013 | Lenox et al. |
| 8,426,974 | B2 | 4/2013 | Linderman et al. |
| 8,448,391 | B2 | 5/2013 | Botkin et al. |
| 8,448,652 | B2 | 5/2013 | Almy et al. |
| 8,449,238 | B2 | 5/2013 | Mulligan et al. |
| 8,450,134 | B2 | 5/2013 | De Ceuster et al. |
| 8,450,985 | B2 | 5/2013 | Gray et al. |
| 8,451,638 | B2 | 5/2013 | Chapman et al. |
| 8,455,806 | B2 | 6/2013 | Judkins |
| 8,456,876 | B2 | 6/2013 | Chapman |
| 8,460,963 | B2 | 6/2013 | Smith |
| 8,461,813 | B2 | 6/2013 | Chapman |
| 8,462,518 | B2 | 6/2013 | Marroquin et al. |
| 8,482,947 | B2 | 7/2013 | Chapman et al. |
| 8,486,746 | B2 | 7/2013 | Rim et al. |
| 8,492,253 | B2 | 7/2013 | Manning |
| 8,503,200 | B2 | 8/2013 | Chapman et al. |
| 8,508,964 | B2 | 8/2013 | Gray et al. |
| 8,516,754 | B2 | 8/2013 | Botkin et al. |
| 8,519,729 | B2 | 8/2013 | Capulong et al. |
| D690,453 | S | 9/2013 | Guercio et al. |
| 8,528,366 | B2 | 9/2013 | Berrada Sounni et al. |
| 8,530,990 | B2 | 9/2013 | Linderman et al. |
| 8,534,007 | B2 | 9/2013 | Almy et al. |
| 8,546,681 | B2 | 10/2013 | Wares et al. |
| 8,548,637 | B2 | 10/2013 | Lenox |
| 8,552,288 | B2 | 10/2013 | Xavier |
| 8,557,093 | B2 | 10/2013 | Cousins et al. |
| 8,558,101 | B2 | 10/2013 | Mascolo et al. |
| 8,563,849 | B2 | 10/2013 | Johnston et al. |
| 8,567,134 | B1 | 10/2013 | Grushkowitz et al. |
| 8,572,836 | B2 | 11/2013 | Lenox |
| 8,580,599 | B2 | 11/2013 | Rim et al. |
| 8,584,406 | B2 | 11/2013 | Wexler et al. |
| 8,584,667 | B2 | 11/2013 | Linderman et al. |
| 8,586,397 | B2 | 11/2013 | Wu et al. |
| 8,586,403 | B2 | 11/2013 | Harley et al. |
| 8,597,970 | B2 | 12/2013 | Cousins et al. |
| 8,599,587 | B2 | 12/2013 | Chapman et al. |
| 8,604,404 | B1 | 12/2013 | Linderman |
| 8,609,977 | B2 | 12/2013 | Jones et al. |
| 8,611,107 | B2 | 12/2013 | Chapman et al. |
| 8,615,941 | B2 | 12/2013 | Botkin et al. |
| 8,624,561 | B1 | 1/2014 | Slavin |
| 8,624,621 | B2 | 1/2014 | Capulong et al. |
| 8,629,383 | B2 | 1/2014 | Beardsworth et al. |
| 8,630,077 | B2 | 1/2014 | Johnston et al. |
| 8,634,216 | B2 | 1/2014 | Chapman |
| 8,636,198 | B1 | 1/2014 | Linderman et al. |
| 8,647,911 | B2 | 2/2014 | Smith |
| 8,650,813 | B2 | 2/2014 | Botkin et al. |
| 8,656,660 | B2 | 2/2014 | Danning |
| 8,658,454 | B2 | 2/2014 | Pass et al. |
| D700,991 | S | 3/2014 | Johnson et al. |
| 8,661,753 | B2 | 3/2014 | Lenox |
| 8,662,008 | B2 | 3/2014 | Abas et al. |
| 8,664,519 | B2 | 3/2014 | De Ceuster et al. |
| 8,679,889 | B2 | 3/2014 | Cousins et al. |
| D703,858 | S | 4/2014 | Miller |
| 8,683,761 | B2 | 4/2014 | Danning |
| 8,692,111 | B2 | 4/2014 | Kim et al. |
| 8,709,851 | B2 | 4/2014 | Dennis et al. |
| 8,712,745 | B2 | 4/2014 | Wayne et al. |
| 8,716,596 | B1 | 5/2014 | Swanson |
| 8,737,093 | B1 | 5/2014 | Baker et al. |
| 8,737,100 | B2 | 5/2014 | Chapman et al. |
| 8,744,791 | B1 | 6/2014 | Kraft et al. |
| 8,748,736 | B2 | 6/2014 | Luan et al. |
| 8,754,627 | B1 | 6/2014 | Le |
| 8,757,567 | B2 | 6/2014 | Ciasulli et al. |
| 8,763,316 | B2 | 7/2014 | Concho et al. |
| 8,767,421 | B2 | 7/2014 | Chapman |
| 8,772,894 | B2 | 7/2014 | Smith |
| 8,774,007 | B2 | 7/2014 | Hussain et al. |
| 8,776,781 | B2 | 7/2014 | Meydbray |
| 8,778,787 | B2 | 7/2014 | Manning |
| 8,785,233 | B2 | 7/2014 | Loscutoff et al. |
| 8,785,236 | B2 | 7/2014 | Harley et al. |
| 8,785,830 | B2 | 7/2014 | Judkins |
| 8,786,095 | B2 | 7/2014 | Linderman et al. |
| 8,790,957 | B2 | 7/2014 | Li et al. |
| 8,793,942 | B2 | 8/2014 | Almy et al. |
| 8,796,061 | B2 | 8/2014 | Bunea |
| 8,796,535 | B2 | 8/2014 | Linderman |
| 8,796,884 | B2 | 8/2014 | Naiknaware et al. |
| 8,802,486 | B2 | 8/2014 | Li et al. |
| 8,809,671 | B2 | 8/2014 | Linderman et al. |
| 8,815,631 | B2 | 8/2014 | Cousins |
| 8,817,510 | B2 | 8/2014 | Esram et al. |
| 8,818,924 | B2 | 8/2014 | Wayne et al. |
| 8,822,257 | B2 | 9/2014 | Rim et al. |
| 8,822,262 | B2 | 9/2014 | Loscutoff et al. |
| 8,822,812 | B2 | 9/2014 | Wares |
| 8,823,356 | B2 | 9/2014 | Chapman |
| 8,824,178 | B1 | 9/2014 | Baker et al. |
| 8,839,784 | B2 | 9/2014 | Wares et al. |
| 8,842,454 | B2 | 9/2014 | Johnson et al. |
| 8,859,933 | B2 | 10/2014 | Harley et al. |
| 8,860,162 | B2 | 10/2014 | Linderman et al. |
| 8,860,242 | B1 | 10/2014 | Pruett et al. |
| 8,877,617 | B2 | 11/2014 | Wong et al. |
| 8,878,053 | B2 | 11/2014 | Cousins |
| 8,881,415 | B2 | 11/2014 | Barton |

(56) References Cited

U.S. PATENT DOCUMENTS 8,883,247 B2 11/2014 Cousins et al.
8,893,713 B2 11/2014 Wares et al.
8,901,010 B2 12/2014 Westerberg et al.
8,904,717 B2 12/2014 Lenox
8,912,038 B2 12/2014 Li et al.
8,922,062 B2 12/2014 Johnson et al.
8,922,185 B2 12/2014 Ehlmann et al.
8,929,094 B2 1/2015 Marroquin et al.
8,943,765 B2 2/2015 Danning et al.
8,945,978 B2 2/2015 Behnke
8,946,541 B2 2/2015 Wares et al.
8,955,267 B2 2/2015 Wexler et al.
8,956,018 B2 2/2015 Deshpande et al.
8,962,082 B2 2/2015 Pavani et al.
8,962,373 B2 2/2015 Cousins et al.
8,963,185 B2 2/2015 Cousins
8,963,375 B2 2/2015 DeGraaff
8,964,401 B2 2/2015 Escamilla et al.
8,975,175 B1 3/2015 Pass
8,975,717 B2 3/2015 Smith
8,988,096 B1 3/2015 Naiknaware
8,991,682 B2 3/2015 Linderman et al.
8,992,803 B2 3/2015 Loscutoff et al.
9,010,041 B2 4/2015 Danning
9,018,033 B2 4/2015 Wu et al.
9,018,516 B2 4/2015 Shepherd et al.
9,020,653 B2 4/2015 Lenox
9,029,689 B2 5/2015 Phu et al.
9,035,167 B2 5/2015 Swanson et al.
9,035,168 B2 5/2015 Barton
9,035,172 B2 5/2015 Kim et al.
9,035,633 B1 5/2015 Slavin et al.
9,038,421 B2 5/2015 Berrada Sounni et al.
9,048,740 B2 6/2015 Gray et al.
9,054,255 B2 6/2015 Swanson et al.
9,059,604 B2 6/2015 Johnson
9,062,854 B2 6/2015 Livesay et al.
9,065,354 B2 6/2015 Chapman et al.
9,070,804 B2 6/2015 Cousins
9,077,202 B1 7/2015 Baker
9,082,925 B2 7/2015 Solomon et al.
9,083,121 B2 7/2015 DeGraaff et al.
9,087,939 B2 7/2015 Harley et al.
9,093,919 B2 7/2015 Chapman et al.
9,101,082 B1 8/2015 Dorenkamp et al.
9,112,066 B2 8/2015 Dennis et al.
9,112,097 B2 8/2015 Tu
9,116,202 B2 8/2015 Capulong et al.
9,136,710 B1 9/2015 Baker et al.
9,142,696 B2 9/2015 Loscutoff et al.
9,147,795 B2 9/2015 Li et al.
9,153,712 B2 10/2015 Zhu
9,159,521 B1 10/2015 Chen et al.
9,160,408 B2 10/2015 Krohne et al.
9,166,079 B2 10/2015 Manning
9,178,104 B2 11/2015 Moors et al.
9,184,324 B2 11/2015 Wares et al.
9,184,327 B2 11/2015 Rose et al.
9,185,759 B2 11/2015 Nieberlein et al.
9,186,741 B2 11/2015 Kumaria et al.
9,190,839 B2 11/2015 Johnston et al.
9,193,014 B2 11/2015 Danning
9,196,758 B2 11/2015 Rim et al.
D744,684 S 12/2015 Guercio et al.
D744,690 S 12/2015 Boyer et al.
9,202,960 B2 12/2015 Luan et al.
9,212,808 B2 12/2015 Higley et al.
9,217,206 B2 12/2015 Behnke et al.
9,219,173 B2 12/2015 Swanson et al.
9,222,193 B2 12/2015 Abas et al.
9,224,902 B2 12/2015 Swanson
9,225,256 B2 12/2015 Chapman et al.
9,225,285 B2 12/2015 Peurach et al.
9,231,129 B2 1/2016 Harley et al.
9,231,145 B2 1/2016 Smith
9,239,153 B2 1/2016 Goodman et al.
9,240,682 B2 1/2016 Sivakumar et al.
9,243,818 B2 1/2016 Shugar et al.
9,246,037 B2 1/2016 Linderman
9,246,046 B1 1/2016 Harrington et al.
9,249,044 B2 2/2016 Judkins et al.
9,249,523 B2 2/2016 Rim
9,252,314 B2 2/2016 Wares et al.
9,252,319 B2 2/2016 Loscutoff et al.
9,253,935 B2 2/2016 Morris et al.
9,257,575 B1 2/2016 Pass et al.
9,257,847 B2 2/2016 Johnson et al.
9,263,183 B2 2/2016 Chapman et al.
9,263,601 B2 2/2016 Wu et al.
9,263,602 B2 2/2016 Harley et al.
9,263,622 B2 2/2016 Pass et al.
9,263,625 B2 2/2016 Smith et al.
9,263,895 B2 2/2016 Naiknaware et al.
9,266,468 B2 2/2016 Mizushiro et al.
9,267,649 B2 2/2016 Janik et al.
D751,976 S 3/2016 Mackler et al.
9,273,845 B2 3/2016 Eom et al.
9,276,635 B2 3/2016 Rothblum et al.
9,279,457 B2 3/2016 Grushkowitz
9,279,569 B2 3/2016 Lamonato et al.
9,281,419 B2 3/2016 Klein et al.
9,281,429 B2 3/2016 Xavier et al.
9,281,431 B2 3/2016 Linderman
9,285,081 B2 3/2016 Douglas et al.
9,293,624 B2 3/2016 Cudzinovic et al.
9,300,224 B2 3/2016 Johnson et al.
D754,064 S 4/2016 Mackler et al.
9,303,285 B2 4/2016 Piazza et al.
9,306,085 B2 4/2016 Westerberg et al.
9,312,042 B2 4/2016 Sewell et al.
9,312,406 B2 4/2016 Loscutoff et al.
9,312,425 B2 4/2016 Kim et al.
9,316,417 B2 4/2016 Danning
9,322,437 B2 4/2016 Agullo
9,322,963 B2 4/2016 Linderman et al.
9,326,339 B2 4/2016 Nieberlein et al.
9,328,427 B2 5/2016 Behnke
9,329,322 B2 5/2016 Yamada et al.
9,337,369 B2 5/2016 Smith
9,342,088 B2 5/2016 Batten et al.
9,347,619 B2 5/2016 Schupple et al.
9,353,970 B2 5/2016 Linderman et al.
9,362,427 B2 6/2016 Sewell et al.
2002/0181229 A1 12/2002 Wei
2009/0091929 A1 4/2009 Faubion
2010/0046225 A1 2/2010 Zheng
2011/0068687 A1 3/2011 Takahasi et al.
2011/0312119 A1 12/2011 Rose et al.
2012/0106148 A1 5/2012 De Silva
2012/0134189 A1 5/2012 Krein
2012/0180845 A1 7/2012 Cole et al.
2012/0192925 A1 8/2012 Grushkowitz et al.
2012/0216852 A1 8/2012 Almy et al.
2012/0300460 A1* 11/2012 Liu ..... F21V 19/02
362/249.02
2013/0000694 A1 1/2013 Bunea et al.
2013/0050999 A1 2/2013 Simon
2013/0106196 A1 5/2013 Johnson et al.
2013/0239947 A1 9/2013 Almy et al.
2013/0255749 A1 10/2013 Kinyon et al.
2013/0305787 A1 11/2013 Berrada Sounni et al.
2013/0340379 A1 12/2013 Danning
2013/0340380 A1 12/2013 Danning
2014/0000187 A1 1/2014 Botkin et al.
2014/0000695 A1 1/2014 Stone
2014/0000705 A1 1/2014 Sounni et al.
2014/0014499 A1 1/2014 Cousins et al.
2014/0034111 A1 2/2014 Bunea et al.
2014/0034122 A1 2/2014 Cousins
2014/0034455 A1 2/2014 Mulligan et al.
2014/0036563 A1 2/2014 Chapman et al.
2014/0048119 A1 2/2014 Johnston et al.
2014/0090637 A1 4/2014 Grushkowitz
2014/0090638 A1 4/2014 Grushkowitz

(56) References Cited

U.S. PATENT DOCUMENTS

| | | | |
|---|---|---|---|
| 2014/0090701 | A1 | 4/2014 | Rim et al. |
| 2014/0102505 | A1 | 4/2014 | Lenox |
| 2014/0102512 | A1 | 4/2014 | Jones et al. |
| 2014/0116495 | A1 | 5/2014 | Kim et al. |
| 2014/0133197 | A1 | 5/2014 | Chapman |
| 2014/0150846 | A1 | 6/2014 | Beardsworth et al. |
| 2014/0174905 | A1 | 6/2014 | Landry |
| 2014/0182661 | A1 | 7/2014 | Kinyon |
| 2014/0190561 | A1 | 7/2014 | De Ceuster et al. |
| 2014/0202492 | A1 | 7/2014 | Grossman et al. |
| 2014/0238470 | A1 | 8/2014 | Ciasulli et al. |
| 2014/0261626 | A1 | 9/2014 | Ripoll Agullo |
| 2014/0268908 | A1 | 9/2014 | Zhou et al. |
| 2014/0290715 | A1 | 10/2014 | Meydbray |
| 2014/0291521 | A1 | 10/2014 | Rössinger et al. |
| 2014/0291852 | A1 | 10/2014 | Linderman et al. |
| 2014/0305501 | A1 | 10/2014 | Li et al. |
| 2014/0306092 | A1 | 10/2014 | Judkins |
| 2014/0311054 | A1 | 10/2014 | Concho et al. |
| 2014/0322855 | A1 | 10/2014 | Bunea |
| 2014/0345688 | A1 | 11/2014 | Cousins |
| 2014/0352761 | A1 | 12/2014 | Linderman et al. |
| 2014/0373910 | A1 | 12/2014 | Luan et al. |
| 2015/0000724 | A1 | 1/2015 | Pass et al. |
| 2015/0004737 | A1 | 1/2015 | Harley |
| 2015/0020867 | A1 | 1/2015 | Linderman et al. |
| 2015/0040944 | A1 | 2/2015 | Dinwoodie et al. |
| 2015/0047690 | A1 | 2/2015 | Shen et al. |
| 2015/0053248 | A1 | 2/2015 | Rim et al. |
| 2015/0083215 | A1 | 3/2015 | Cousins |
| 2015/0090328 | A1 | 4/2015 | Smith |
| 2015/0090329 | A1 | 4/2015 | Pass |
| 2015/0108692 | A1 | 4/2015 | Harley et al. |
| 2015/0117067 | A1 | 4/2015 | Naiknaware et al. |
| 2015/0122305 | A1 | 5/2015 | Marroquin et al. |
| 2015/0128437 | A1 | 5/2015 | Barton |
| 2015/0144197 | A1 | 5/2015 | Cousins et al. |
| 2015/0146315 | A1 | 5/2015 | Wares et al. |
| 2015/0155819 | A1 | 6/2015 | Wexler et al. |
| 2015/0163074 | A1 | 6/2015 | Pruett et al. |
| 2015/0180238 | A1 | 6/2015 | DeGraaff |
| 2015/0180404 | A1 | 6/2015 | Braunstein et al. |
| 2015/0194539 | A1 | 7/2015 | Shepherd et al. |
| 2015/0194927 | A1 | 7/2015 | Naiknaware |
| 2015/0206988 | A1 | 7/2015 | Loscutoff et al. |
| 2015/0212535 | A1 | 7/2015 | Ehlmann et al. |
| 2015/0214744 | A1 | 7/2015 | Lenox |
| 2015/0222225 | A1 | 8/2015 | Danning |
| 2015/0229221 | A1 | 8/2015 | Gray et al. |
| 2015/0249405 | A1 | 9/2015 | Chapman et al. |
| 2015/0249423 | A1 | 9/2015 | Braunstein et al. |
| 2015/0263200 | A1 | 9/2015 | Dennis et al. |
| 2015/0270803 | A1 | 9/2015 | Barton |
| 2015/0280038 | A1 | 10/2015 | Sethi et al. |
| 2015/0282365 | A1 | 10/2015 | Escamilla et al. |
| 2015/0287875 | A1 | 10/2015 | Phu et al. |
| 2015/0288328 | A1 | 10/2015 | Swanson et al. |
| 2015/0311357 | A1 | 10/2015 | Harley et al. |
| 2015/0325710 | A1 | 11/2015 | Tu |
| 2015/0326168 | A1 | 11/2015 | Johnson |
| 2015/0326178 | A1 | 11/2015 | Capulong et al. |
| 2015/0333617 | A1 | 11/2015 | Chapman et al. |
| 2015/0340868 | A1 | 11/2015 | Chapman |
| 2015/0342084 | A1 | 11/2015 | Dorenkamp et al. |
| 2015/0349158 | A1 | 12/2015 | Manning |
| 2015/0349706 | A1 | 12/2015 | Grossman et al. |
| 2015/0349709 | A1 | 12/2015 | Ponec et al. |
| 2015/0364625 | A1 | 12/2015 | Solomon et al. |
| 2015/0372638 | A1 | 12/2015 | DeGraaff et al. |
| 2015/0377518 | A1 | 12/2015 | Maxey et al. |
| 2015/0380578 | A1 | 12/2015 | Zhu |
| 2016/0011246 | A1 | 1/2016 | Fischer et al. |
| 2016/0020827 | A1 | 1/2016 | Krohne et al. |
| 2016/0027953 | A1 | 1/2016 | Moors et al. |
| 2016/0028345 | A1 | 1/2016 | Wares et al. |
| 2016/0035908 | A1 | 2/2016 | Rose et al. |
| 2016/0036380 | A1 | 2/2016 | Johnston et al. |
| 2016/0043267 | A1 | 2/2016 | Rim et al. |
| 2016/0043684 | A1 | 2/2016 | Harif |
| 2016/0064576 | A1 | 3/2016 | Luan et al. |
| 2016/0065119 | A1 | 3/2016 | Danning |
| 2016/0071991 | A1 | 3/2016 | Smith |
| 2016/0071996 | A1 | 3/2016 | Swanson et al. |
| 2016/0071999 | A1 | 3/2016 | Loscutoff et al. |
| 2016/0079450 | A1 | 3/2016 | Harley et al. |
| 2016/0079911 | A1 | 3/2016 | Rose et al. |
| 2016/0087425 | A1 | 3/2016 | Sivakumar et al. |
| 2016/0090662 | A1 | 3/2016 | Capulong et al. |
| 2016/0105027 | A1 | 4/2016 | Johnson et al. |
| 2016/0108541 | A1 | 4/2016 | Abas et al. |
| 2016/0111583 | A1 | 4/2016 | Harrington et al. |
| 2016/0112003 | A1 | 4/2016 | Morris et al. |
| 2016/0118516 | A1 | 4/2016 | Harley et al. |
| 2016/0133759 | A1 | 5/2016 | Pass et al. |
| 2016/0133767 | A1 | 5/2016 | Smith et al. |
| 2016/0134233 | A1 | 5/2016 | Chapman et al. |
| 2016/0142100 | A1 | 5/2016 | Rothblum et al. |
| 2016/0156309 | A1 | 6/2016 | Almogy et al. |
| 2016/0164300 | A1 | 6/2016 | Johnson et al. |
| 2016/0164427 | A1 | 6/2016 | Chapman et al. |

FOREIGN PATENT DOCUMENTS

| | | | |
|---|---|---|---|
| EP | 2206949 | A1 | 7/2010 |
| EP | 2292971 | A1 | 3/2011 |
| EP | 2960570 | A1 | 12/2015 |
| EP | 3067616 | A1 | 9/2016 |
| TW | M366030 | U | 10/2009 |
| WO | 2008145065 | A1 | 12/2008 |

OTHER PUBLICATIONS

Flex Essentials Series Sell Specification Sheets, Published Jun. 2016 (28 pages).

Flex Lighting Solutions Specification Sheet, Essentials Series, Published May 2017 (9 pages).

First Office Action issued in Chinese Patent Application No. 201810427349.1 dated May 25, 2020, with English translation.

* cited by examiner

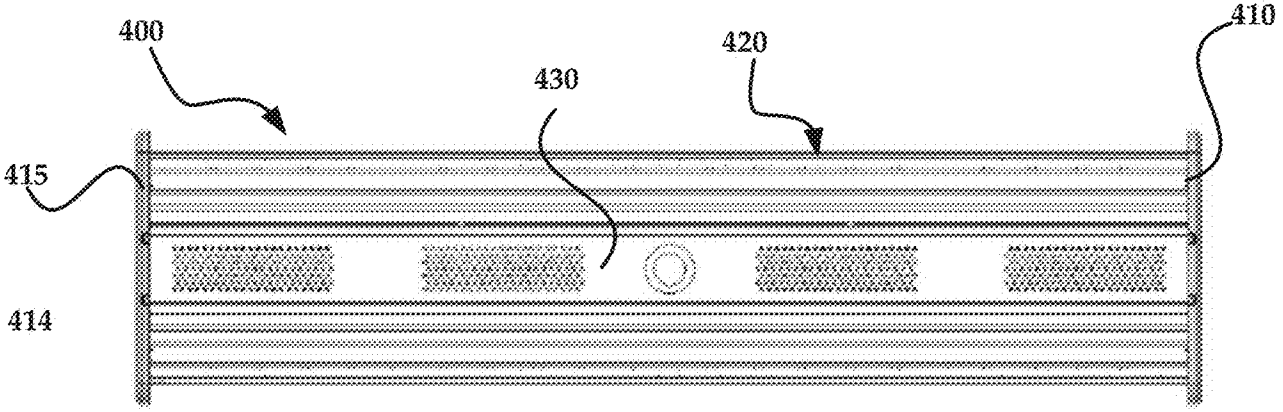
FIG. 4B
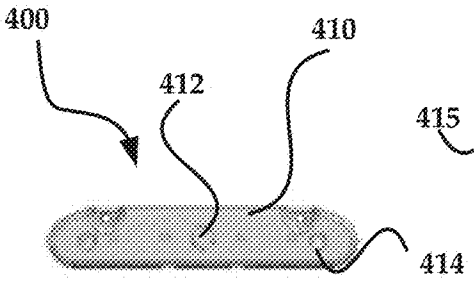
FIG. 4A
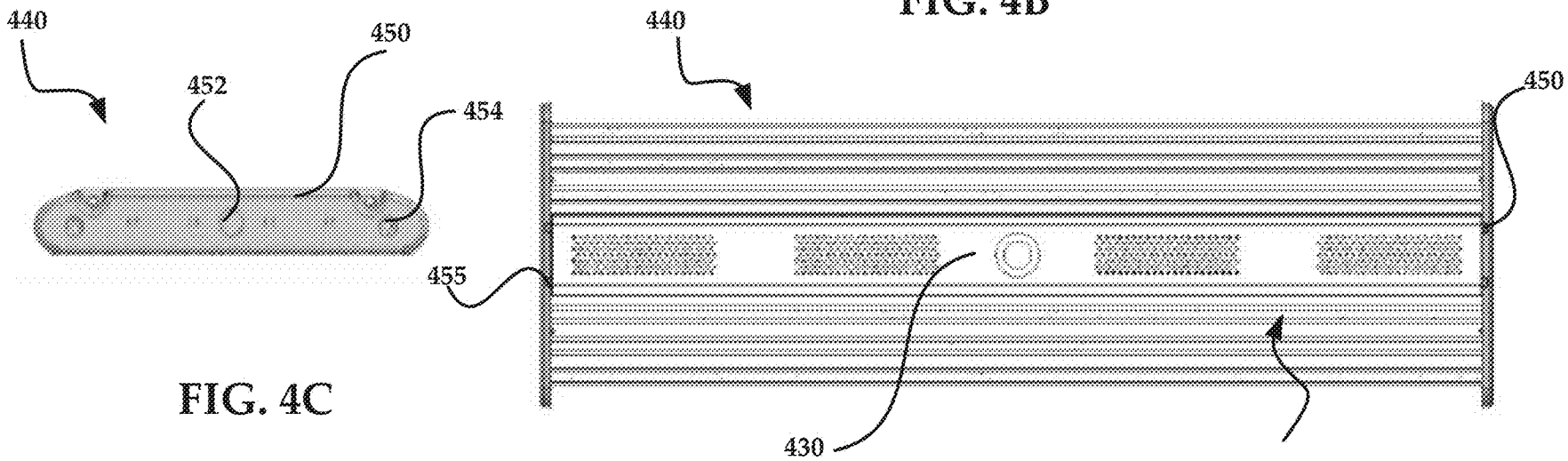
FIG. 4D
FIG. 4C

LIGHT FIXTURE DEVICE INCLUDING ROTATABLE LIGHT MODULES

CROSS-REFERENCE TO RELATED APPLICATIONS

The instant application claims priority under 35 U.S.C. § 119 to U.S. Provisional Application Ser. No. 62/502,026, the entire contents of which are incorporated herein by reference.

BACKGROUND

Technical Field

The present disclosure relates to lighting fixtures. More particularly, the present invention relates to a device for fixing a light to enable light to be directed in a custom manner.

Discussion of Related Art

Lighting, also referred to as artificial lights, are important in commercial and residential environments. Indoor lighting is critical for use of interior spaces during day and night. Outdoor lighting enables the use of outdoor spaces safely during periods of darkness. Lights can be expensive to install and operate. Light emitting diode (LED) lights can reduce the costs of installing and operating lights due to their long useful operating life and relatively low energy usage.

Large interior spaces require many lights to make them safe and useful. Overlapping light cones from adjacent light fixtures enable sets of lights to work together to create a bright and safe work area in a large interior space. Most light from lights designed for large interior spaces having high ceilings is directed downward since work is performed at floor level, and the overlapping light cones provide sufficient illumination toward the ceiling.

However, one problem with typical light fixtures designed for large interior spaces is that the edge of the space may not benefit from the overlapping light cones, particularly when the light fixtures hang down significantly from the ceiling. Therefore, a "cave effect" may occur, where an upper part of the wall may not be illuminated, or may be only dimly illuminated. Therefore, there is a need for a light fixture that eliminates the cave effect.

SUMMARY

Provided in accordance with the present disclosure is a device for directing light. The device includes at least two light modules adapted to provide a fixture for a light source. The at least two light modules are linear, parallel to a central axis, substantially in a plane with the central axis, and arranged on both sides of the central axis in the plane. A first inner endcap is provided that is arranged on a first end of the at least two light modules and a second inner endcap is provided that is arranged on a second end of the at least two light modules. The first end opposes the second end along a length of the two light modules. The first and second inner endcaps provide a fixed, rotational axis for at least one of the light modules, and provide at least two locking positions to determine a rotational position for the light module.

In an aspect of the present disclosure, the at least two locking positions include at least two detents on the first inner endcap. The at least two detents on the first inner endcap may be selectable by a pin adapted to engage one of the at least two detents.

In another aspect of the present disclosure, the at least two locking positions are four locking positions. The four locking positions may include four detents on the first inner endcap, and the four detents on the first inner end may be selectable by a tab adapted to engage one of the four detents.

In yet another aspect of the present disclosure, one of the first inner endcap and the second inner endcap may include a locking arrangement adapted to secure the rotational position of at least one of the light modules.

In another aspect of the present disclosure, the at least one light module is farthest from the central axis on a first side of the central axis and is designated a first outer light module.

In further aspects of the present disclosure, one other light module of the least two light modules is farthest from the central axis on a second side of the central axis and is designated a second outer light module. The two inner endcaps may provide another fixed, rotational axis for the second outer light module, and may provide two second locking positions to determine a second rotational position for the second outer light module.

The at least two light modules may be two light modules, may be four light modules, may be six light modules, or may be any number of light modules.

The at least two locking positions may be four locking positions determining the rotational position for the first outer light module. The other at least two second locking positions may be four second locking positions determining the second rotational position for the second outer light module.

A device according to aspects of the present disclosure may include a wireway positioned along the central axis. The wireway may be linear and may accommodate wiring.

A device according to further aspects of the present disclosure may include two outer endcaps arranged on opposing ends of the two light modules. The two outer endcaps may be mechanically coupled to the two inner endcaps and may provide a seal to inhibit ingress into an interior of the device.

In additional aspects of the present disclosure, the at least two light modules may be arranged in equal numbers on both sides of the central axis in the plane.

The present disclosure additionally provides a light fixture including at least two light modules adapted to provide a fixture for a light source. The at least two light modules are linear, parallel to a central axis, substantially in a plane with the central axis, and arranged on both sides of the central axis in the plane. A first inner endcap is arranged on an end of the light modules and a second inner endcap is arranged on a second end of the light modules. The first end opposes the second end along a length of the light modules. The first and second inner endcaps provide a fixed, rotational axis for at least one of the light modules, and provide locking positions to determine a rotational position for the light module. The locking positions include detents on the first inner endcap selectable by a pin adapted to engage one of the detents.

In an aspect of the present disclosure, one of the endcaps includes a locking arrangement adapted to secure the rotational position of the light module.

In another aspect of the present disclosure, the at least one light module is farthest from the central axis on a first side of the central axis and is designated a first outer light module. At least one other light module is farthest from the central axis on a second side of the central axis and is designated a second outer light module. The two inner endcaps provide another fixed, rotational axis for the second outer light module, and provide at least two further locking positions to determine a second rotational position for the second outer light module.

In yet another aspect of the present disclosure, four locking positions determine the rotational position for the first outer light module, and four further locking positions determine the second rotational position for the second outer light module.

In still further aspects of the present disclosure, a wireway is positioned along the central axis. The wireway is linear and accommodates wiring.

In another aspect of the present disclosure, two outer endcaps are arranged on opposing ends of the at least two light modules. The two outer endcaps may be mechanically coupled to the two inner endcaps and may provide a seal to inhibit ingress into an interior of the device.

Further, to the extent consistent, any of the aspects described herein may be used in conjunction with any or all of the other aspects described herein.

BRIEF DESCRIPTION OF THE DRAWINGS

Various aspects and features of the present disclosure are described herein below with references to the drawings.

FIGS. 4A-4B are diagrams illustrating an end view and a plan view of a light fixture according to the present technology having four light modules.

FIGS. 4C-4D are diagrams illustrating an end view and a plan view of a light fixture according to the present technology having six light modules.

DETAILED DESCRIPTION

Figure 1:
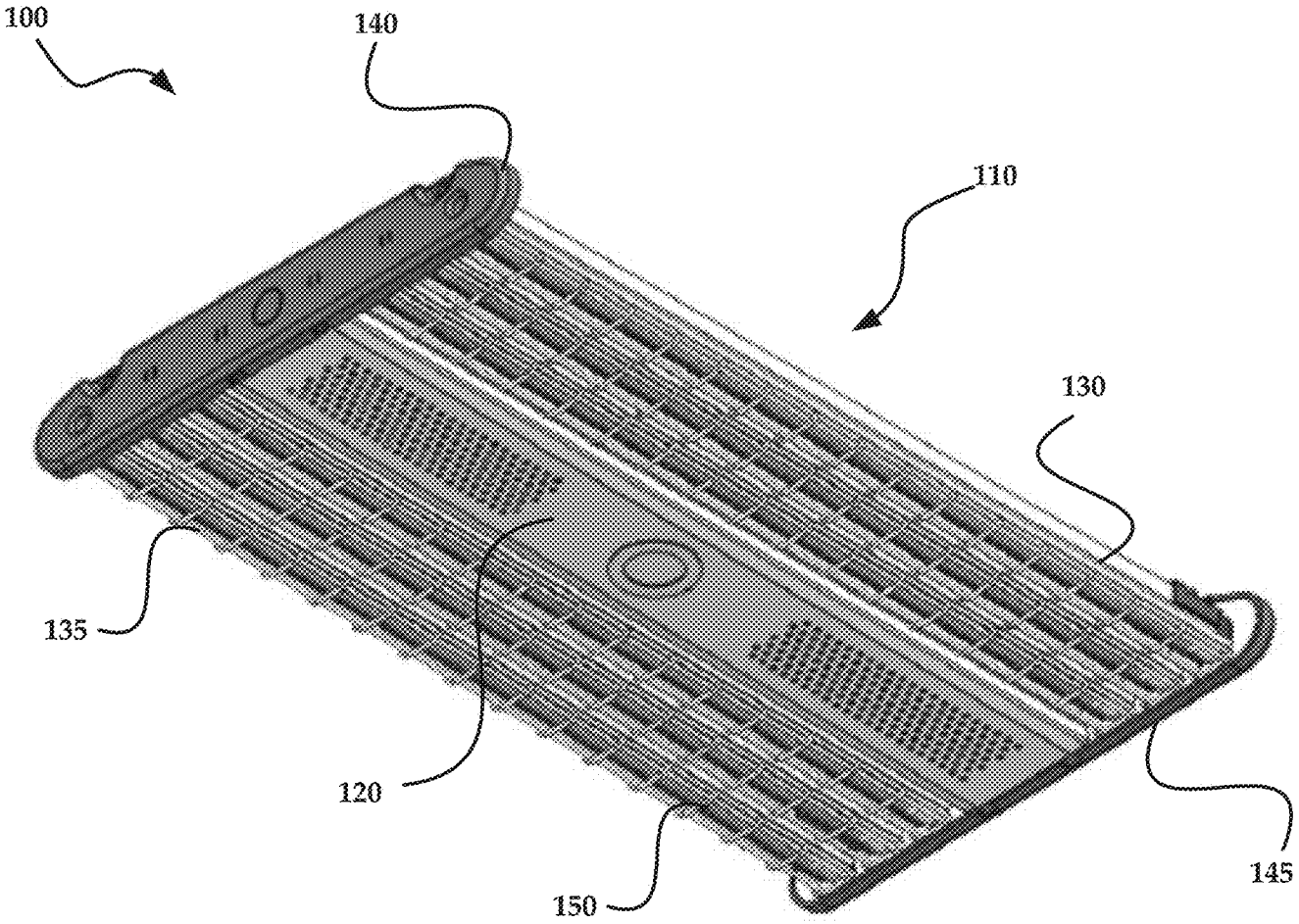
FIG. 1 is a perspective view of an exemplary embodiment of a light fixture according to the present technology.

The present disclosure is directed, in part, to devices and methods for providing artificial light. In particular, the present technology addresses problems associated with conventional lighting of interior and exterior spaces. Light modules (also referred to as light fixtures, fixtures, or modules) are provided having mounts that include rotatable outer light modules. In this manner, a custom light cone can be set providing different light distributions. For example, when lighting areas above the fixture to eliminate the "cave effect", the outer light modules may be aimed upwards to light these areas. Light modules may also include a light-emitting diode (LED) pattern on a printed circuit board (PCB), thermally conductive tape, and/or an aluminum heatsink.

The rotatable outer light modules include a module locking mechanism that is designed to set the rotation angles conveniently and safely lock the modules in place. The locking mechanism may include a rotation selector, also referred to as a lock. The rotation selector may engage with a selector detent, also referred to as a detent or a hole, to determine a rotational position for a light module.

In alternative exemplary embodiments, only one outer light module may be rotatable, modules other than the outer light modules may be rotatable, and in some exemplary embodiments, all of the light modules are rotatable.

The rotatable outer light modules may be adjustable before, during, or after installation. Adjustment of the rotatable outer light modules may be accomplished by first loosening screws on the outermost modules with a hex driver. However, in other exemplary embodiments, no locking screws may be included in the outer light module. The next step in the adjustment process is to locate the locks at the ends of the outermost modules, and then pull and hold the lock. At this point, the outer light module may be rotated to the next detent, or another detent, and the lock released. The lock may snap in place. In exemplary embodiments including screws for locking the module rotation, the next step is to tighten the screws to lock the modules at the set angles.

Modular wire guards may be provided that include steel wire guards for protecting the lenses. The module wire guards may be designed to protect only one module each, and in this manner, the modular design may be used to fit any number of modules. In this manner, the same wire guard may be used in light fixtures having two, four, six, or any number of light modules per fixture.

Light modules according to the present technology may include a heatsink designed for LED modules that includes a custom, optimized aluminum extruded heatsink to efficiently cool LEDs using natural convection.

Light modules according to the present technology may also include a custom extruded plastic lenses with engineered optics to provide maximum light transmission and provide various types of light distribution (for example, wide and aisle distributions).

Light fixtures according to the present technology may include an LED pattern on a PCB. One design adapted for use with the present technology includes 144 LEDs in series and/or parallel strings.

The disclosure is further directed to a wireway in the light fixtures, which may be extruded aluminum and/or may be used as a housing and/or a heatsink for the LED drivers.

Embodiments of the present disclosure are now described in detail with reference to the drawings in which like reference numerals designate identical or corresponding elements in each of the several views. Additionally, in the drawings and in the description that follows, terms such as front, rear, upper, lower, top, bottom, and similar directional terms are used simply for convenience of description and are not intended to limit the disclosure. In the following description, well-known functions or constructions are not described in detail to avoid obscuring the present disclosure in unnecessary detail.

With reference to FIG. 1, light fixture 100 is shown in a perspective view. Light fixture 100 includes light modules 110. As shown in FIG. 1, light fixture 100 includes six light modules, each being linear and with three light modules arranged on one side of wireway 120, and three light modules arranged on the other side of wireway 120. Alternatively, light fixture 100 may include two or four light modules, or more, which may be arranged in equal numbers on either side of wireway 120. In still further exemplary embodiments, the number of light modules may not be evenly divided on either side of wireway 120, and light fixture 100 may include an odd number of light modules. Light modules 110 include a first outer light module 130, which is positioned farthest from wireway 120. Additionally, a second outer light module 135 may be positioned on an opposite side of wireway 120 from the first outer light module 130, and farthest from wireway 120 on that side. The first outer light module 130, and/or the second outer light module 135, may rotate according to the present technology to provide a custom light cone useful for eliminating an edge effect in a large interior illuminated space. Arranged on opposing ends of light modules 110 and wireway 120 are first endcap 140 and second endcap 145. Light modules 110 in light fixture 100 may include or may be provided with, wire guards 150 to protect lights and or lenses of the light modules from impacts without excessively impairing the illumination provided by the light modules. As shown in FIG. 1, wire guard 150 is a modular wire guard arranged on outer light module 135, and each module 110 has a separate wire guard 150.

Figure 2:
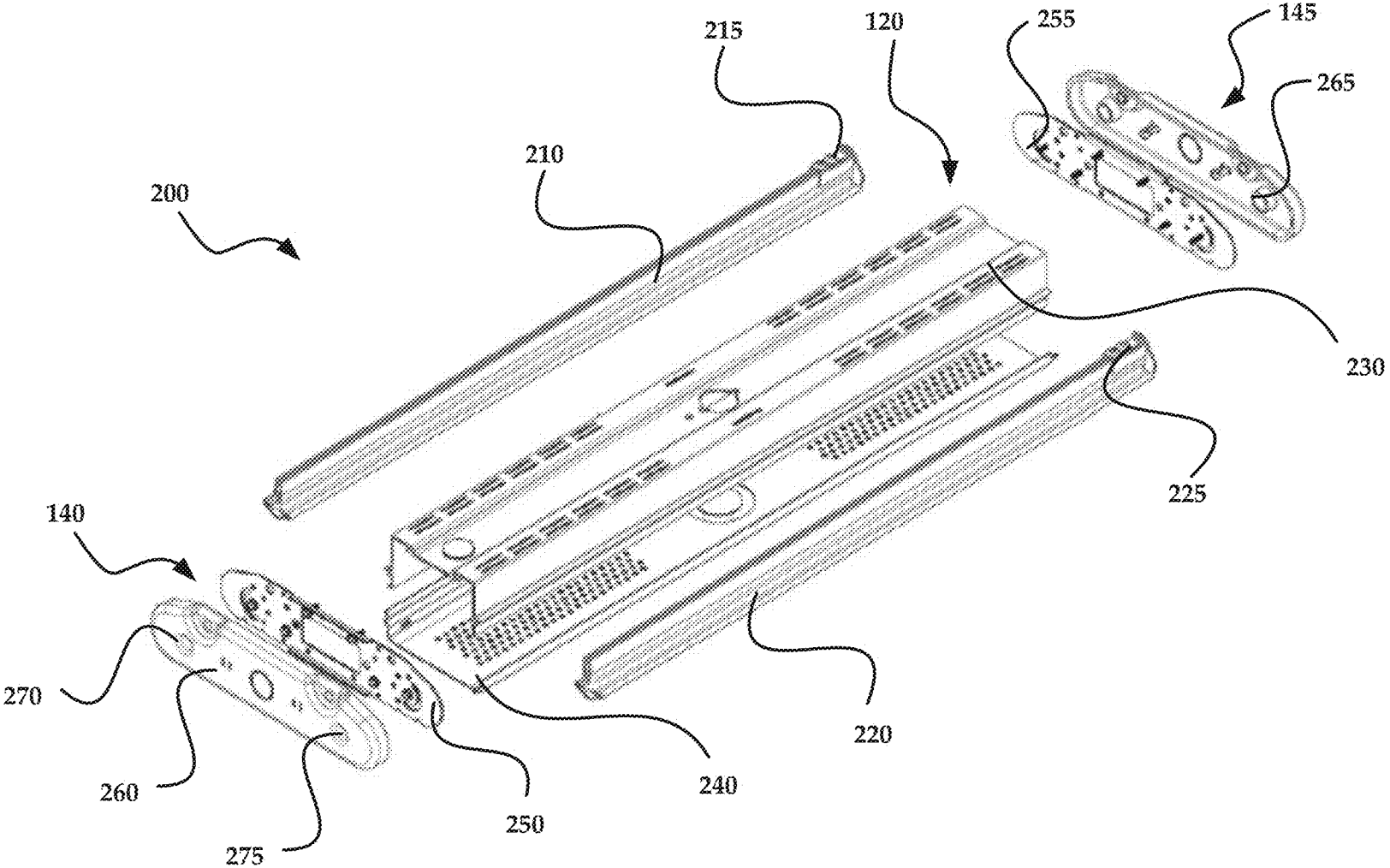
FIG. 2 is an exploded view of an exemplary embodiment of a light fixture according to the present technology.

FIG. 2 is an exploded view of light fixture 200 according to the present technology. Light fixture 200 includes two light modules, namely first outer light module 210 and second outer light module 220. Wireway 120 is shown in FIG. 2 disassembled into upper wireway section 230 and lower wireway section 240. Upper wireway section 230 and lower wireway section 240 may combine to form wireway 120, including an interior space to accommodate wires and/or drivers for powering LED lights in first outer light module 210 and second outer light module 220. Wireway 120 may also function as a heatsink for the LED drivers. Wireway 120 may permit direct access to electrical components housed therein upon removal of lower wireway section 240 from the upper wireway section 230.

First endcap 140 is shown in FIG. 2 disassembled into first inner endcap 250 and first outer endcap 260. Second endcap 145 is also shown in FIG. 2 disassembled into second inner endcap 255 and second outer endcap 265. First inner endcap 250 and second inner endcap 255 may attach to, or alternatively, function as mounting plates for, opposite ends of first outer light module 210, second outer light module 220, and wireway 120. In this manner, the relative distances and directions between first outer light module 210, second outer light module 220, and wireway 120 with respect to each other may be fixed.

First outer light module 210 may be rotatable along an axis extending from first inner endcap 250 to second inner endcap 255, through first outer light module 210. Additionally or alternatively, second outer light module 220 may be rotatable along an axis extending from first inner endcap 250 to second inner endcap 255, through second outer light module 220. First outer light module 210 may include first rotation selector 215 on one end adjacent to second inner endcap 255.

Additionally or alternatively, first outer light module 210 may have a rotation selector at the other end, or both ends. First rotation selector 215 may enable first outer light module 210 to be positioned in one of four pre-set angles, for example 0 degrees, 45 degrees, 90 degrees, and 135 degrees. Alternatively, more or fewer pre-set angles may be selectable by first rotation selector 215.

Second outer light module 220 may include second rotation selector 225 on one end. Additionally or alternatively, second outer light module 220 may have a rotation selector at the other end, or both ends. Second rotation selector 225 may enable second outer light module 220 to be positioned in one of four pre-set angles, for example 0 degrees, 45 degrees, 90 degrees, and 135 degrees. Alternatively, more or fewer pre-set angles may be selectable by second rotation selector 225.

First outer endcap 260 and second outer endcap 265 may be composed of plastic or any other appropriate material, and may provide an aesthetic appearance and/or operate to protect the wiring of the module assemblies. First locking arrangement 270 for first outer light module 210 is shown on first outer endcap 260, and second locking arrangement 275 for second outer light module 220 is also shown on first outer endcap 260. First and second locking arrangements 270, 275 may include screws adapted to engage first and second outer light modules 210, 220, respectively. Alternatively, any appropriate locking arrangement may be used. The position of first locking arrangement 270 may correspond to the point of intersection for the rotational axis of first outer light module 210 and first outer endcap 260. The position of second locking arrangement 275 may correspond to the point of intersection for the rotational axis of second outer light module 220 and first outer endcap 260.

FIGS. 3A-3D are diagrams illustrating second inner endcap 255, first outer light module 210 and second outer light module 220 in different rotational positions. In particular, FIGS. 3A-3D are cross-sectional views of a light fixture according to the present disclosure, viewed from an interior in the direction of second inner endcap 255. In each of FIGS. 3A-3D, first outer light module 210 and second outer light module 220 are both in the same rotational position. Alternatively, first outer light module 210 and second outer light module 220 may be positioned in rotational positions different from each other, and/or only one of first outer light module 210 and second outer light module 220 may be rotatable.

Figure 3A:
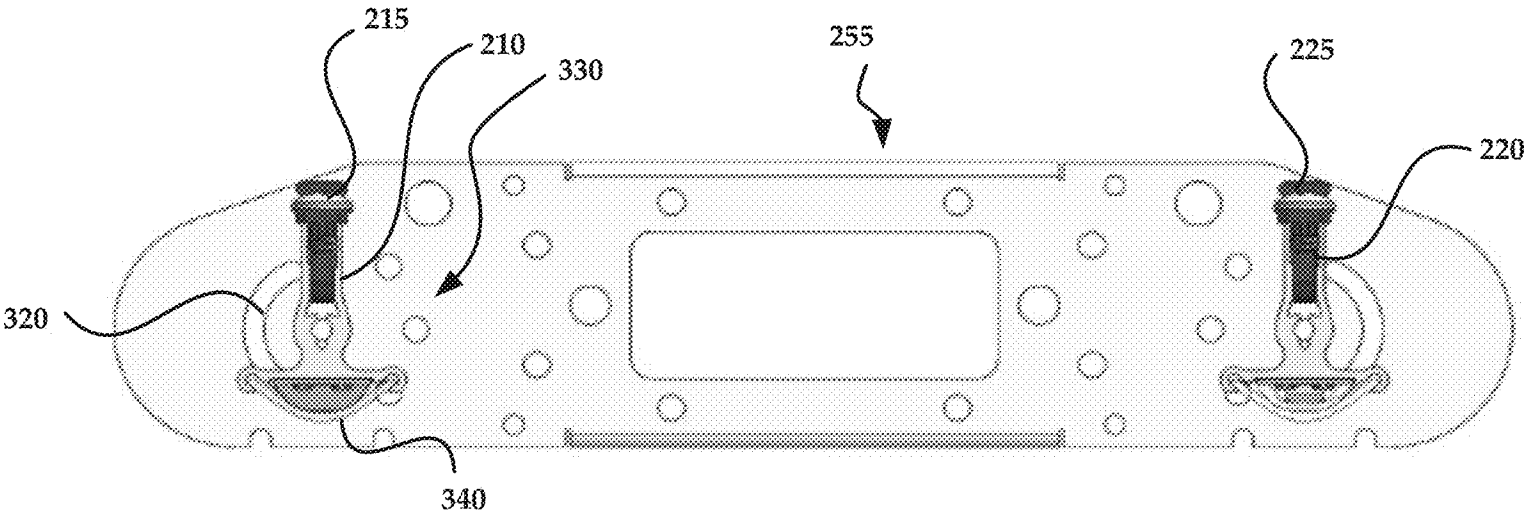
FIGS. 3A-3D are diagrams illustrating an inner endcap and outer light modules illustrating different rotation positions for the outer light modules according to an exemplary embodiment of the present technology.

FIG. 3A illustrates first outer light module 210 and second outer light module 220 in a default rotational position with respect to second inner endcap 255, with lens 340 of first outer light module 210 directed downwards. This default position may be referred to as the first position, 0 degrees, or 0 degrees down. In this position, light emitted from first outer light module 210 may be directed downwards. The rotational position of first outer light module 210 may be selected using first rotation selector 215, which may engage with first detent 332 (shown in FIG. 3B) of selector detents 330 on second inner endcap 255. The rotational position of second outer light module 220 may be selected using second rotation selector 225.

Wireslot 320 may allow wires connecting to first outer light module 210 to move through a range of rotation of first outer light module 210, so that the lighting function of first outer light module 210 is not impaired by rotation through the range. The wireslot 320 may also act as an end stop and prevent rotation of the light module 210 beyond the desired end of the wireslot 320.

Figure 3B:
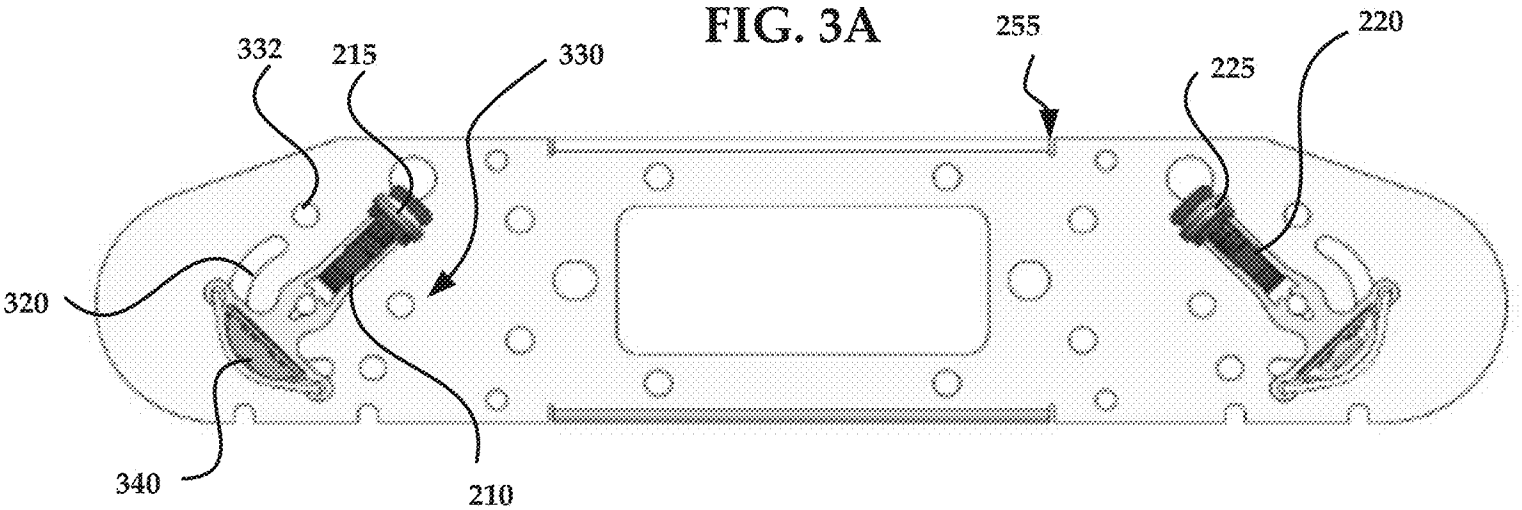

FIG. 3B illustrates first outer light module 210 and second outer light module 220 in a second rotational position with respect to second inner endcap 255, with lens 340 of first outer light module 210 directed downwards and slightly outwards. This second position may also be referred to as 45 degrees or 45 degrees out. Additionally, this second position may be at any appropriate angle other than 45 degrees. In this position, light emitted from first outer light module 210 may be directed down and outwards. The rotational position of first outer light module 210 may be selected using first rotation selector 215, which may engage with second detent 334 (shown in FIG. 3C) of selector detents 330 on second inner endcap 255. First detent 332 of selector detents 330 is shown in FIG. 3B, and corresponds to the default position. Therefore, first detent 332 is selected by first rotation selector 215 for the rotational position shown in FIG. 3A. The rotational position of second outer light module 220 may be selected using second rotation selector 225. Also shown in FIG. 3B is wireslot 320.

Figure 3C:
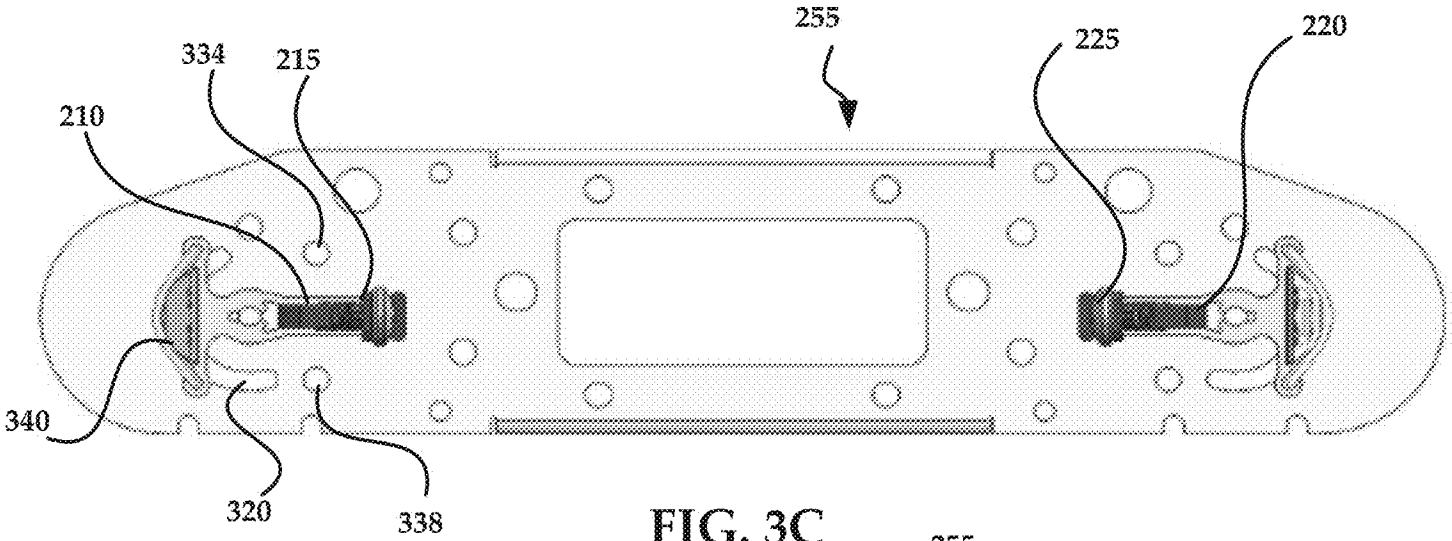

FIG. 3C illustrates first outer light module 210 and second outer light module 220 in a third rotational position with respect to second inner endcap 255, with lens 340 of first outer light module 210 directed outwards. This third position may also be referred to as 90 degrees or 90 degrees out. Additionally, this third position may be at any appropriate angle other than 90 degrees. In this position, light emitted from first outer light module 210 may be directed outwards. The rotational position of first outer light module 210 may be selected using first rotation selector 215, which may engage with third detent 336 (shown in FIG. 3D) on second inner endcap 255. Second detent 334 of selector detents 330 is shown in FIG. 3C, and corresponds to the second position. Therefore, second detent 334 is selected by first rotation selector 215 for the rotational position shown in FIG. 3B. Fourth detent 338 of selector detents 330 is shown in FIG. 3C, and corresponds to the fourth position, to be discussed in regard to FIG. 3D. Therefore, fourth detent 338 is selected by first rotation selector 215 for the rotational position shown in FIG. 3D. The rotational position of second outer light module 220 may be selected using second rotation selector 225. Also shown in FIG. 3C is wireslot 320.

Figure 3D:
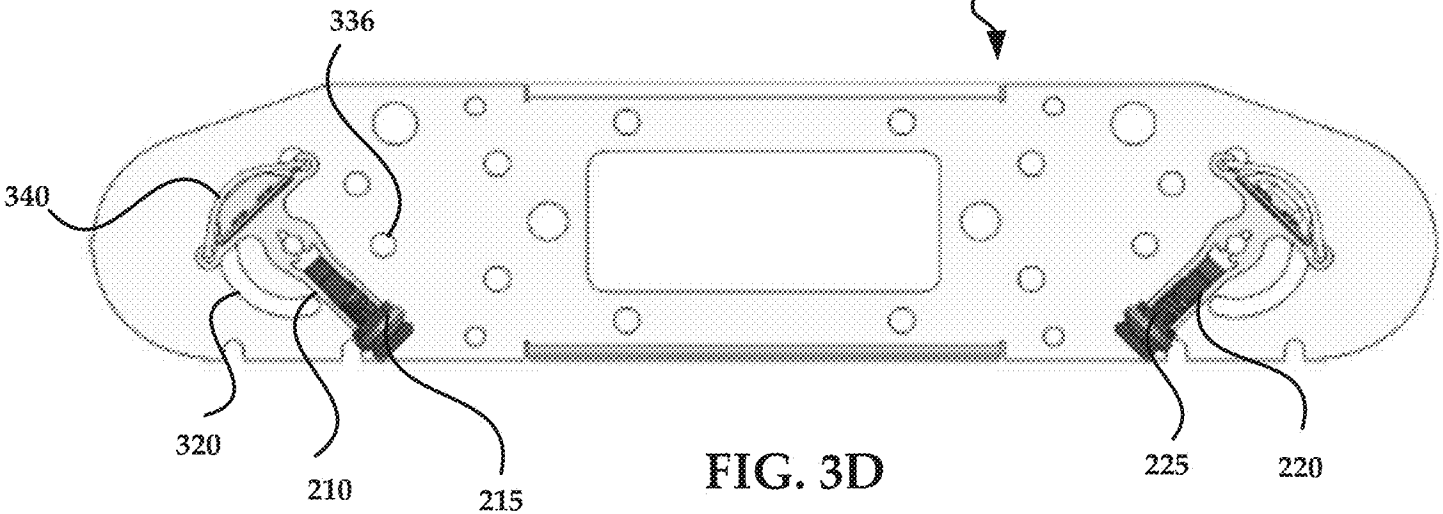

FIG. 3D illustrates first outer light module 210 and second outer light module 220 in a fourth rotational position with respect to second inner endcap 255, with lens 340 of first outer light module 210 directed outwards and slightly upwards. This fourth position may also be referred to as up, 135 degrees, or 135 degrees up. Additionally, this fourth position may be at any appropriate angle other than 135 degrees. In this position, light emitted from first outer light module 210 may be directed outwards and upwards. The rotational position of first outer light module 210 may be selected using first rotation selector 215, which may engage with fourth detent 338 (shown in FIG. 3C) on second inner endcap 255. Third detent 336 of selector detents 330 is shown in FIG. 3D, and corresponds to the third position. Therefore, third detent 336 is selected by first rotation selector 215 for the rotational position shown in FIG. 3C. The rotational position of second outer light module 220 may be selected using second rotation selector 225. Also shown in FIG. 3D is wireslot 320.

FIG. 4A is an end view of light fixture 400 having four light modules according to the present technology. FIG. 4A shows first four-module outer endcap 410. Centrally located in first four-module outer endcap 410 is first central axis endpoint 412, which identifies a central axis of first four-module outer endcap 410, and which corresponds to the endpoint of a wireway for first four-module outer endcap 410. Also shown in FIG. 4A is rotational axis endpoint 414 for one of the outer modules of first four-module outer endcap 410, which identifies the endpoint of a rotation axis for first four-module outer endcap 410. Rotational axis endpoint 414 also may correspond to the position for an arrangement to secure first outer light module 210 to second inner endcap 255, and/or the position for a locking arrangement, for example a screw, hex bolt, or any other appropriate locking system.

FIG. 4B is a plan view of light fixture 400, including four long light modules 420. Two of the four long light modules 420 are arranged on one side of wireway 430, and the other two of the four long light modules 420 are arranged on the other side of wireway 430. The four long light modules 420 and wireway 430 extend from first four-module outer endcap 410 to second four-module outer endcap 415. The relative length of light fixture 400 shown in FIG. 4B is for illustration purposes only, and in alternative exemplary embodiments, light fixture 400 may be shorter or longer as measured by the distance between first four-module outer endcap 410 and second four-module outer endcap 415.

FIG. 4C is an end view of light fixture 440 having six light modules according to the present technology. FIG. 4A shows first six-module outer endcap 450. Centrally located in first six-module outer endcap 450 is first central axis endpoint 452, which identifies a central axis of first six-module outer endcap 450, and which corresponds to the endpoint of a wireway for first six-module outer endcap 450. Also shown in FIG. 4C is rotational axis endpoint 454 for one of the outer modules of first six-module outer endcap 450, which identifies the endpoint of a rotation axis for first six-module outer endcap 450.

FIG. 4D is a plan view of light fixture 440, including six long light modules 460. Three of the six long light modules 460 are arranged on one side of wireway 430, and the other three of the six long light modules 460 are arranged on the other side of wireway 430. The six long light modules 440 and wireway 430 extend from first six-module outer endcap 450 to second six-module outer endcap 455. The length of light fixture 440 shown in FIG. 4D is for illustration purposes only, and in alternative exemplary embodiments, light fixture 440 may be shorter or longer.

Figure 5B:
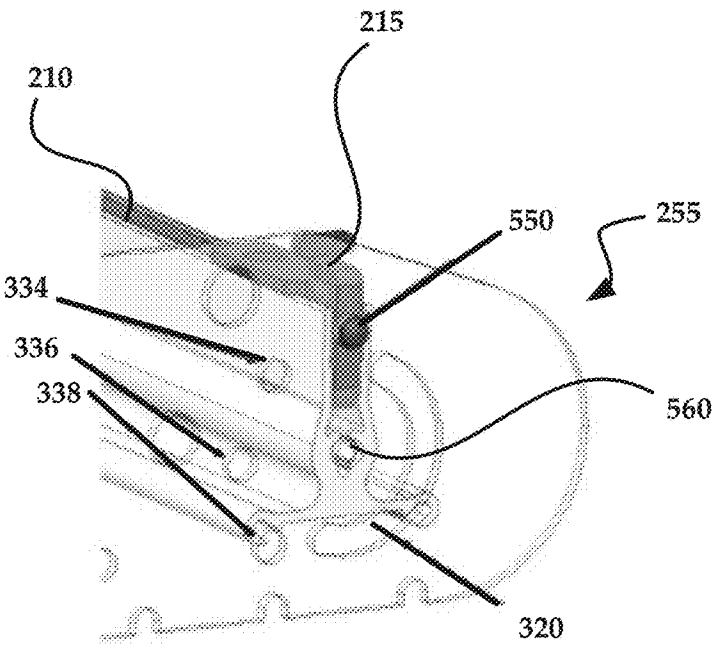
FIG. 5B is a partial, perspective view of an inner endcap, shown in a semi-transparent condition, and a light module end illustrating a rotation functionality for the light module according to an exemplary embodiment of the present technology.
Figure 5A:
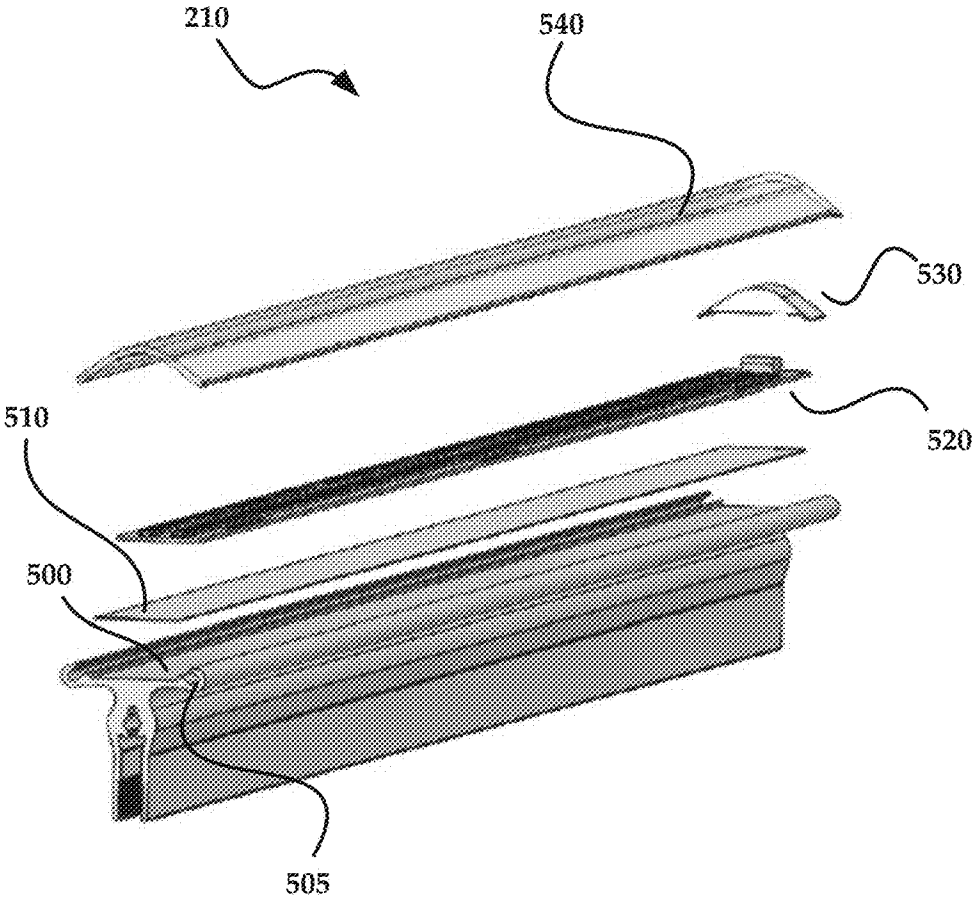
FIG. 5A is a diagram illustrating an exploded view of a light module according to an exemplary embodiment of the present technology.

FIG. 5A is a diagram illustrating an exploded view of light module 210 according to an exemplary embodiment of the present technology. Shown in FIG. 5A is heatsink 500, which may be formed by extruding aluminum. A thermal tape 510, which may be thermally conductive adhesive tape used to attach PCB assembly 520 to heatsink 500. In alternative exemplary embodiments, thermal tape 510 may not be used, and PCB assembly 520 may be attached to heatsink 500 by any appropriate method such as screws, rivets, and other mechanical fasteners. PCB assembly 520 may include LEDs and connectors on a printed circuit board. At an end of PCB assembly 520 may be positioned connector cover 530, which may be a flame retardant cover for a connector on PCB assembly 520. Covering the length of PCB assembly 520 may be lens 540, which may be an extruded plastic lens, or a lens made of any other appropriate material. As shown the heatsink 500 may include two recesses 505 for receiving portions of lens 540.

FIG. 5B is a partial, perspective view of second inner endcap 255 shown in a semi-transparent condition. Also shown in FIG. 5B is first outer light module 210 having first rotation selector 215 arranged at an end adjacent to second inner endcap 255. Shown on second inner endcap 255 in FIG. 5B are second detent 334, third detent 336, fourth detent 338, and wireslot 320. In FIG. 5B, pin 550 engages a first detent to position the light module in a downward directed manner, also referred to as 0 degrees and 0 degrees down. Pin 550 may be disengaged from the first detent and moved to any of second detent 334, third detent 336, and fourth detent 338 by engaging a tab or pull on first rotation selector 215 to retract pin 550 from the first detent and rotating the light module manually about rotational axis endpoint 560. Rotational axis endpoint 560 also may correspond to the position for an arrangement to secure first outer light module 210 to second inner endcap 255, and/or the position for a locking arrangement, for example a screw, hex bolt, or any other appropriate locking system.

Figure 6A:
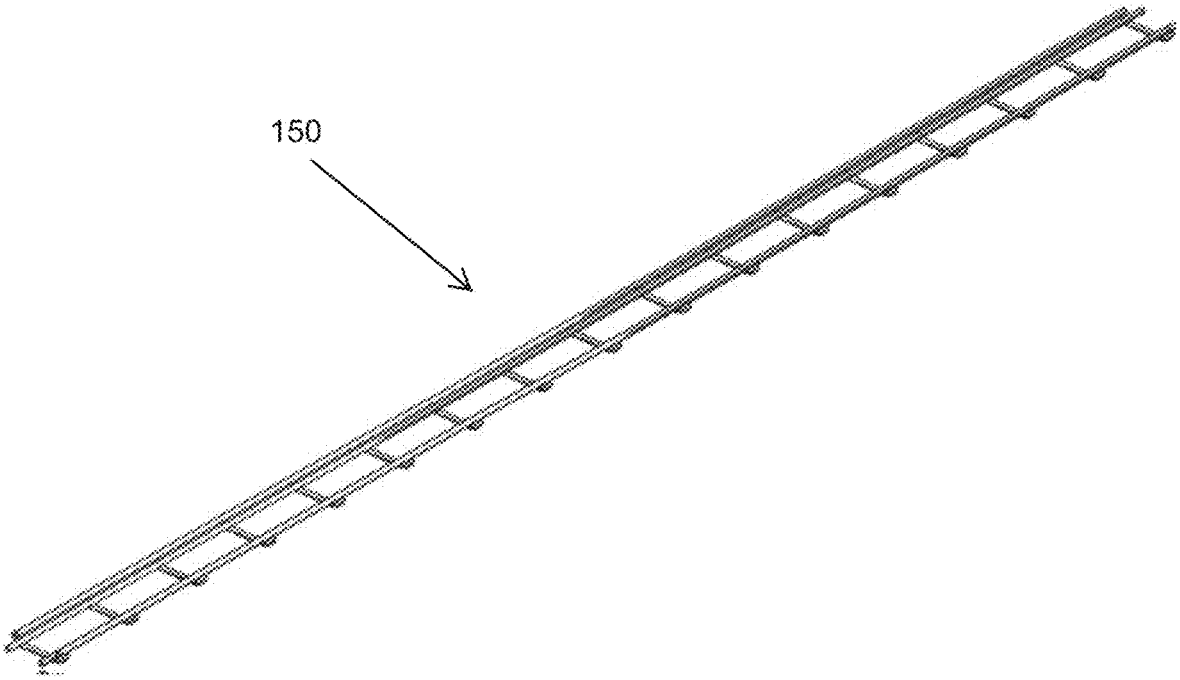
FIG. 6A is a diagram illustrating a wire guard according to an exemplary embodiment of the present technology.
Figure 6B:
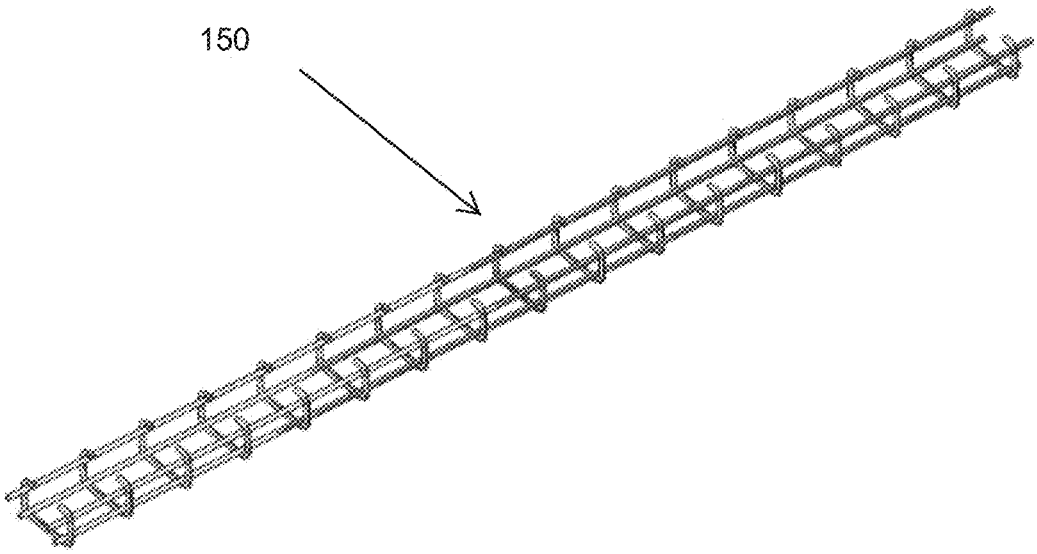
FIG. 6B is a diagram illustrating an alternative wire guard according to an exemplary embodiment of the present technology.

FIGS. 6A and 6B illustrate different forms of wire guard 150 according to an exemplary embodiments of the present technology. Wire guard 150 may be formed from metal, or any other impact and heat resistant material, and may include two or more main wire rods along a length, with small transverse wire rods spanning a distance between the length-wise wire rods. In still further exemplary embodiments, two length-wise wire rods may be positioned on each side of the wire guard 150. Wire guard 150 may attach to a light module by snapping onto a lens, coupling to a cover, or by any other appropriate method. Wire guard 150 may operate to protect lenses from impact strikes. Light fixtures may be shipped with several wire guards 150 installed during assembly, and wire guard 150 may be available in multiple sizes, for instance multiple lengths, including a short and long length to match the light module length. Wire guard 150 may protect both rotatable and non-rotatable light modules, and therefore, one type of wire guard may be used for light fixtures having two, four, six, or any number of light modules.

Figure 6C:
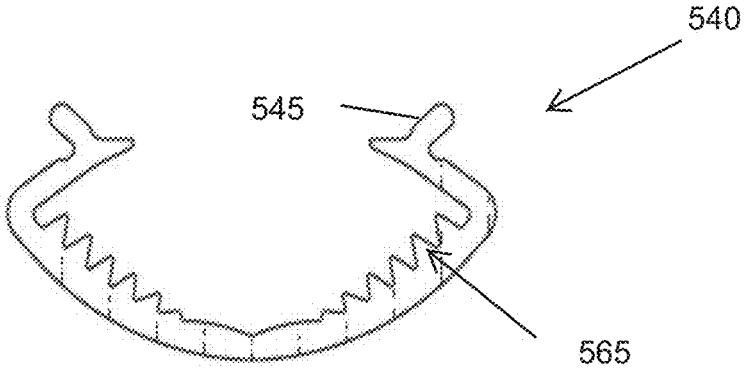
FIG. 6C is a cross-sectional view of a lens according to one embodiment of the present disclosure.
Figure 6D:
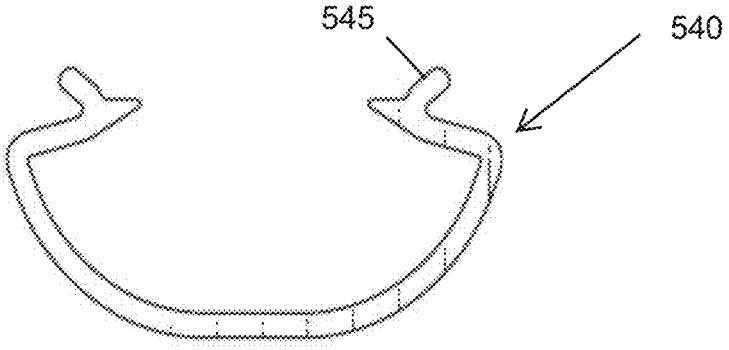
FIG. 6D is a cross-sectional view of an alternative lens according to one embodiment of the present disclosure.

FIGS. 6C and 6D are end views of lens 540. The lenses 540 are shaped with tangs 545 which are received in recesses 505 of the heatsink 500. Diffusers 565 formed on an inner surface of the lenses as shown in FIG. 6C can help shape the projected light. Similarly differences in opacity or other features included on the lenses 540 can be employed to reduce glare, filter certain light wavelengths, or focus light in a particular direction. The spring constant of the polymeric material from which the lenses 540 are formed can be used to ensure that the lenses 540 remain in the recesses. The lenses 540 may be covered with the wire guards 150 depicted in FIGS. 6A and 6B.

Figure 6E:
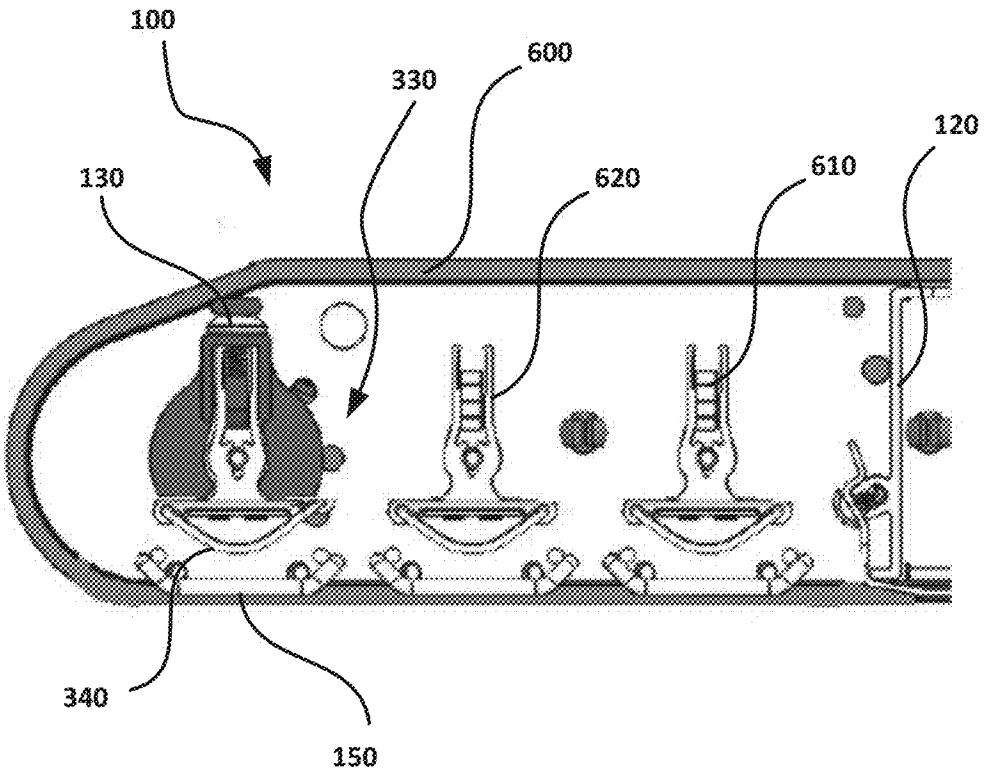
FIG. 6E is a partial cross-sectional view along a rotational axis of a light fixture having three light modules on one side of a wireway, and illustrating the light module having a rotation functionality according to an exemplary embodiment of the present technology.

FIG. 6E is a partial cross-sectional view along a rotational axis of light fixture 100 having three light modules on one side of wireway 120. Light fixture 100 includes cover 600, which may be made of plastic or any other appropriate material. Two light modules 610 and 620 may includes lenses and may be positioned immediately adjacent to wireway 120, and may not be rotatable, i.e., may be fixed. First outer light module 130 may be positioned farthest from wireway 120, and may be rotatable in order to provide custom illumination options. First outer light module 130 may include lens 340, which may be protected by wire guard 150. Wire guard 150 may attach to cover 600, or in alternative exemplary embodiments, may attach to lens 340 or another part of first outer light module 130. First outer light module 130 may be rotatable using selector detents 330. In FIG. 6B, first outer light module 130 is directed downward, also referred to as 0 degrees and 0 degrees down.

Figure 6F:
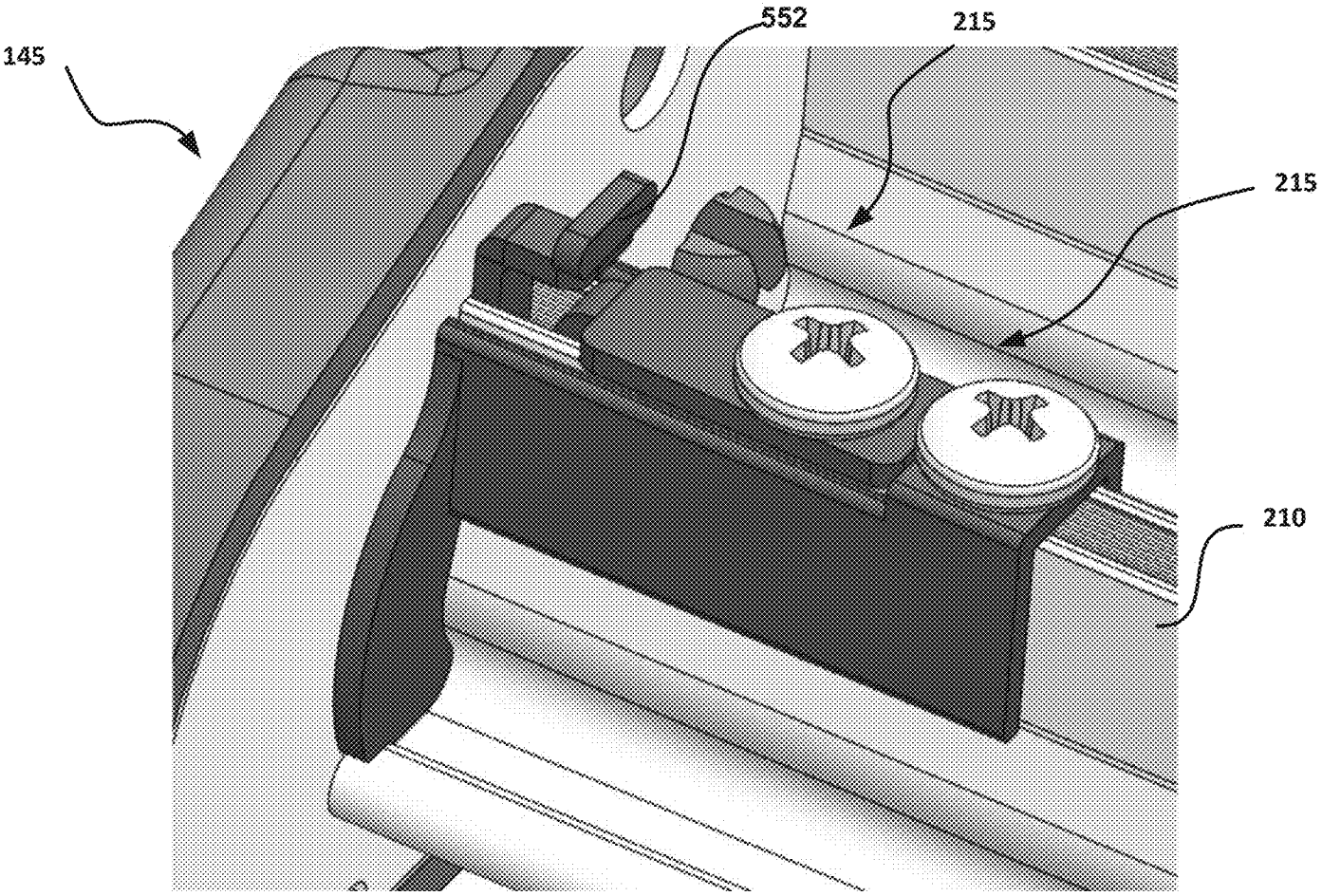
FIG. 6F is a partial perspective view of a rotation selector and an endcap illustrating the light module having a rotation functionality according to an exemplary embodiment of the present technology.
Figure 6G:
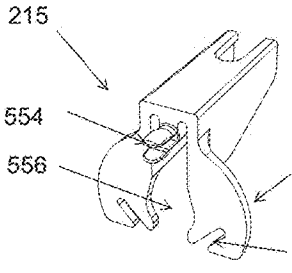
FIGS. 6G-L depict views of an alternative rotation selector according to an exemplary embodiment of the present technology.
Figure 6H:
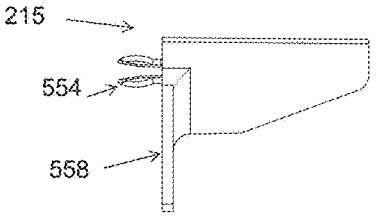
Figure 6I:
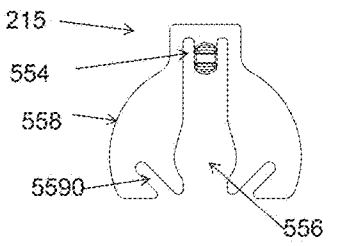
Figure 6J:
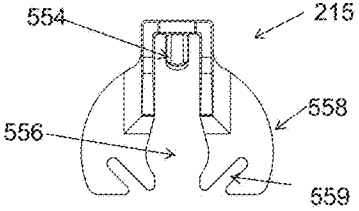
Figure 6K:
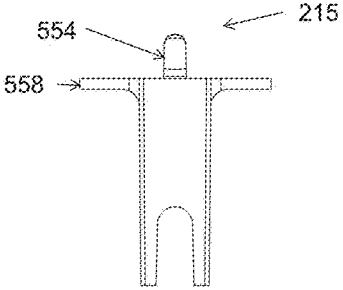
Figure 6L:
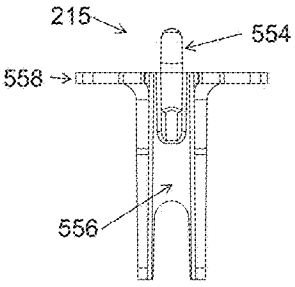

FIG. 6F is a partial perspective view of first rotation selector 215 and second endcap 145. First rotation selector 215 is mounted on an end of first outer light module 210 adjacent to second endcap 145. First rotation selector 215 may be mounted on first outer light module 210 by screws 630, or by any other appropriate attachment method. First rotation selector 215 includes tab 552, which may be a spring activator for a pin to engage selector detents when positioning first outer light module 210. By pulling tab 552 in a direction away from second endcap 145, a pin 550 attached to tab 552 may be disengaged from a selector detent 330, 334, 336, or 338, and first outer light module 210 may be manually rotated into a different position in which the pin 550 can engage with a different selector detent 330, 334, 336, or 338.

Figure 6M:
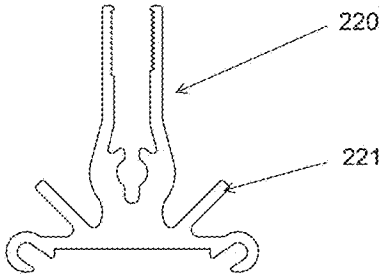
FIG. 6M is an end view of an alternative light module in accordance with an embodiment of the present technology.

FIGS. 6G-6L depict a further embodiment of the present disclosure, a rotation selector 215 having a different locking mechanism and a simplified design to that depicted in FIG. 6F. Instead of a pin 550 engaging selector detents (e.g., 330, 340, 350) a compressible clam shell 554 is provided and is insertable into the selector detent 330, 334, 336, or 338 to position the first outer light module 210. In this embodiment the clam shell 554 compresses to enter into the selector detent and can be re-compressed if a different selector detent 330, 334, 336, 338 is desired. A channel 556 extends from the flange 558 of the rotation selector 215. The channel 556 is shaped to receive the light module 220, and the entire rotation selector can slide on the light module to allow for removal of the rotation selector, and specifically the clam shell 554 from the detent to free the clam shell 554 for rotation of the light module 220 relative to the end cap. In the embodiment of FIGS. 6G-L the rotation selector 215 is prevented from rotating relative to the light module 220 by slots 559 formed in the flange 558. These slots 559 mate with fins formed in the light module 220 that assist in heat dissipation. An example of such a light module 220 can be seen in FIG. 6M. The fins 221 are sized to be received within the slots 550 of the rotation selector 215. Other features of the light module 220 are consistent with those described herein above.

Figure 7:
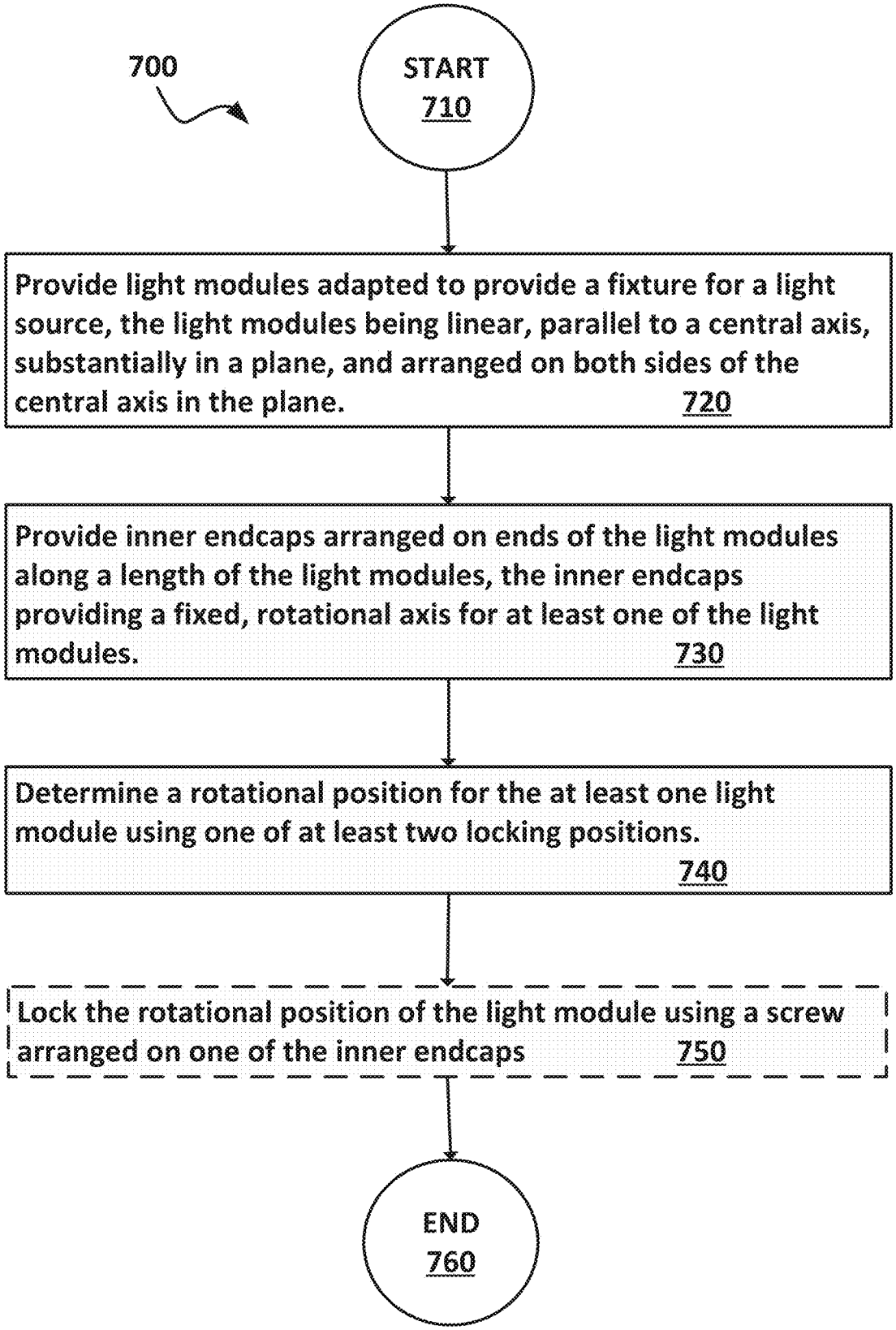
FIG. 7 is a flow chart illustrating an exemplary method according to an exemplary embodiment of the present technology.

FIG. 7 is a flow chart illustrating exemplary method 700 according to an exemplary embodiment of the present technology, in which optional steps are shown with broken lines. Method 700 begins at start circle 710 and proceeds to operation 720, which indicates to provide light modules adapted to provide a fixture for a light source, the light modules being linear, parallel to a central axis, substantially in a plane, and arranged on both sides of the central axis in the plane. From operation 720, the flow in method 700 proceeds to operation 730, which indicates to provide inner endcaps arranged on ends of the light modules along a length of the light modules, the inner endcaps providing a fixed, rotational axis for at least one of the light modules. From operation 730, the flow proceeds to operation 740, which indicates to determine a rotational position for the at least one light module using one of at least two locking positions.

From operation 740, the flow in method 700 proceeds to optional operation 750, which indicates to lock the rotational position of the light module using a screw arranged on one of the inner endcaps. From optional operation 750, the flow in method 700 proceeds to end circle 760.

Detailed embodiments of such devices, systems incorporating such devices, and methods using the same are described above. However, these detailed embodiments are merely examples of the disclosure, which may be embodied in various forms. Therefore, specific structural and functional details disclosed herein are not to be interpreted as limiting but merely as a basis for the claims and as a representative basis for allowing one skilled in the art to variously employ the present disclosure in virtually any appropriately detailed structure. The scope of the technology should therefore be determined with reference to the appended claims along with their full scope of equivalents.

What is claimed:

1. A device for directing light, the device comprising:

at least two light modules adapted to provide a fixture for a light source, the at least two light modules being linear, parallel to a central axis, substantially in a plane with the central axis, and being arranged on both sides of the central axis in the plane; and a first inner endcap arranged on a first end of the at least two light modules and a second inner endcap arranged on a second end of the at least two light modules, the first end opposing the second end along a length of the at least two light modules, the first and second inner endcaps providing a fixed, rotational axis for at least one of the light modules, and at least one of the first and second inner endcaps providing at least two locking positions to determine a rotational position for the at least one light module, wherein at least a first of the at least two locking positions is configured to position the at least one module at 90 degrees out relative to 0 degree down.

2. The device of claim 1, wherein the at least two locking positions comprise at least two detents defined through the first inner endcap, the at least two detents defined through the first inner endcap being selectable by a pin adapted to engage one of the at least two detents.

3. The device of claim 1, wherein:

the at least two locking positions are at least four locking positions; and the at least four locking positions comprise at least four detents on the first inner endcap, the at least four detents on the first inner end being selectable by a tab adapted to engage one of the at least four detents.

4. The device of claim 1, wherein at least one of the first inner endcap and the second inner endcap comprises a locking arrangement adapted to secure the rotational position of the at least one light module.

5. The device of claim 1, wherein the at least one light module is farthest from the central axis on a first side of the central axis and is designated a first outer light module.

6. The device of claim 5, wherein:

at least one other light module of the least two light modules is farthest from the central axis on a second side of the central axis and is designated a second outer light module; and the two inner endcaps provide another fixed, rotational axis for the second outer light module, and provide at least two second locking positions to determine a second rotational position for the second outer light module.

7. The device of claim 6, wherein the at least two light modules are two light modules.

8. The device of claim 6, wherein the at least two light modules are four light modules.

9. The device of claim 6, wherein the at least two light modules are six light modules.

10. The device of claim 6, wherein:

the at least two locking positions are four locking positions determining the rotational position for the first outer light module; and the at least other two second locking positions are four second locking positions determining the second rotational position for the second outer light module.

11. The device of claim 1, further comprising a wireway positioned along the central axis, the wireway being linear and accommodating wiring.

12. The device of claim 1, further comprising two outer endcaps arranged on opposing ends of the at least two light modules, the two outer endcaps being mechanically coupled to the two inner endcaps and providing a seal to inhibit ingress into an interior of the device.

13. The device of claim 1, wherein the at least two light modules are arranged in equal numbers on both sides of the central axis in the plane.

14. The device of claim 1, wherein at least a second of the at least two locking positions is configured to position the at least one light module to 135 degrees up relative to 0 degree down.

15. A light fixture, comprising:

at least two light modules adapted to provide a fixture for a light source, the at least two light modules being linear, parallel to a central axis, substantially in a plane with the central axis, and being arranged on both sides of the central axis in the plane; and a first inner endcap arranged on a first end of the at least two light modules and a second inner endcap arranged on a second end of the at least two light modules, the first end opposing the second end along a length of the at least two light modules, the first and second inner endcaps providing a fixed, rotational axis for at least one of the light modules, and providing at least two locking positions to determine a rotational position for the at least one light module, the at least two locking positions comprising at least two detents defined through the first inner endcap, the at least two detents defined through the first inner endcap being selectable by a pin adapted to engage one of the at least two detents.

16. The light fixture of claim 15, wherein at least one of the first inner endcap and the second inner endcap comprises a locking arrangement adapted to secure the rotational position of the at least one light module.

17. The light fixture of claim 15, wherein:

the at least one light module is farthest from the central axis on a first side of the central axis and is designated a first outer light module;

at least one other light module of the least two light modules is farthest from the central axis on a second side of the central axis and is designated a second outer light module; and the first and second inner endcaps provide another fixed, rotational axis for the second outer light module, and provide at least two further locking positions to determine a second rotational position for the second outer light module.

18. The light fixture of claim 17, wherein:

the at least two locking positions are four locking positions determining the rotational position for the first outer light module; and the at least two further locking positions are four further locking positions determining the second rotational position for the second outer light module.

19. The light fixture of claim 15, further comprising a wireway positioned along the central axis, the wireway being linear and accommodating wiring.

20. The light fixture of claim 15, further comprising two outer endcaps arranged on opposing ends of the at least two light modules, the two outer endcaps being mechanically coupled to the two inner endcaps and providing a seal to inhibit ingress into an interior of the device.

21. A device for directing light, the device comprising:

at least two light modules adapted to provide a fixture for a light source, the at least two light modules being linear, parallel to a central axis, substantially in a plane with the central axis, and being arranged on both sides of the central axis in the plane; and a first inner endcap arranged on a first end of the at least two light modules and a second inner endcap arranged on a second end of the at least two light modules, the first end opposing the second end along a length of the at least two light modules, the first and second inner endcaps providing a fixed, rotational axis for at least one of the light modules, and at least one of the first and second inner endcaps providing at least two locking positions to determine a rotational position for the at least one light module, wherein at least a first of the at least two locking positions is configured to position the at least one module from 90 degrees to 135 degrees up relative to 0 degree down.

* * * * *